US006371034B1

(12) United States Patent
Simpson et al.

(10) Patent No.: US 6,371,034 B1
(45) Date of Patent: Apr. 16, 2002

(54) FOLDING TABLE

(75) Inventors: Peter E. Simpson, White House, TN (US); John J. Refalo, Lebanon, NJ (US)

(73) Assignee: Globe Business Furniture of Tennessee, Inc., Nashville, TN (US)

( * ) Notice: Subject to any disclaimer, the term of this patent is extended or adjusted under 35 U.S.C. 154(b) by 0 days.

(21) Appl. No.: 09/575,743

(22) Filed: May 22, 2000

(51) Int. Cl.[7] ..... A47B 3/00
(52) U.S. Cl. ..... 108/129
(58) Field of Search ..... 108/129, 131, 108/132, 130, 115, 901, 161

(56) References Cited

U.S. PATENT DOCUMENTS

| | | | |
|---|---|---|---|
| 4,189,125 | A | 2/1980 | Little |
| 4,557,200 | A | 12/1985 | Geschwender |
| 4,727,816 | A | 3/1988 | Virtue |
| 4,815,394 | A | 3/1989 | Ettlinger et al. |
| 4,826,265 | A | 5/1989 | Hockenberry |
| 4,841,877 | A | 6/1989 | Virtue |
| 4,869,456 | A | 9/1989 | Jacobs |
| 4,951,576 | A | 8/1990 | Cobos et al. |
| 5,271,338 | A | 12/1993 | Bonham |
| 5,284,100 | A | 2/1994 | Thorn |
| 5,394,808 | A | 3/1995 | Dutro et al. |
| 5,419,524 | A | 5/1995 | Evans et al. |
| 5,421,272 | A | 6/1995 | Wilmore |
| 5,443,020 | A | 8/1995 | Price |
| 5,505,142 | A | 4/1996 | Fink |
| 5,623,882 | A | 4/1997 | Price |
| 5,678,491 | A | 10/1997 | Price et al. |
| 5,694,865 | A | 12/1997 | Raab |
| 5,732,637 | A | 3/1998 | Raab |
| D399,684 | S | 10/1998 | Glass |
| 5,865,128 | A | 2/1999 | Tarnay |
| 5,868,081 | A | 2/1999 | Raab |
| 5,934,203 | A | 8/1999 | Glass |
| 6,112,674 | A | 9/2000 | Stanford |

FOREIGN PATENT DOCUMENTS

| | | |
|---|---|---|
| FR | 2 637 474 | 4/1990 |

*Primary Examiner*—Jose V. Chen
(74) *Attorney, Agent, or Firm*—Flynn, Thiel, Boutell & Tanis, P.C.

(57) ABSTRACT

A table including a one-piece, monolithic plastic top part having a reinforcing rib structure integral therewith and a reinforcing rail arrangement. The rib structure includes a main flange which extends generally downwardly from the lower side of the top part and an edge wall which also extends downwardly and forms a periphery thereof. The edge wall is spaced-apart from and surrounds the main flange. A pair of pivotable leg assemblies are connected to the top at the lower side thereof. The reinforcing rib structure includes a plurality of cross ribs which extend between the edge wall and the main flange on the lower side of the top part. A handle member is also provided on and extends downwardly from the lower side of the top part and is integral therewith for manipulating the table during transport thereof.

17 Claims, 14 Drawing Sheets

FOLDING TABLE

FIELD OF THE INVENTION

This invention relates to a table, such as for an office or similar environment, having a lightweight, one-piece monolithic plastic top part with improved strength and rigidity, and an improved reinforcing rail arrangement provided at the underside of the top part.

BACKGROUND OF THE INVENTION

Numerous types and styles of tables have been developed and utilized, particularly in offices and the like, including tables having a top of a one-piece construction. One such table includes a molded plastic top having a hollow interior formed by blow-molding, which typically results in a thin outer wall thickness. When tables of this known construction are stacked for purposes of storing, however, the tables are easily damaged at the ends and/or corners due to the thin wall construction of the tops. In addition, this known construction results in a table having less than desirable overall strength and structural rigidity.

It is an object of this invention to provide an improved portable table which is light in weight but has improved structural rigidity. More specifically, one aspect of the invention relates to a table including a one-piece, monolithic plastic table top member having a horizontally enlarged top wall and a reinforcing rib structure integral therewith. The rib structure includes a main flange extending generally downwardly from the lower side of the top and defining a generally central cavity thereat, and an edge wall which defines the longitudinal and end edges of the top. The edge wall is spaced-apart from and encircles the main flange. The rib structure includes a plurality of cross ribs extending transversely between the edge wall and the main flange on the lower side of the top wall, and the cross ribs are spaced apart from one another along the periphery of the top wall. The table also includes a leg structure engaged with the top member at the lower side thereof and positioned to project generally downwardly for supportive engagement with a floor.

Another aspect of the invention relates to a table including a horizontally enlarged top having a pair of longitudinal edges joined by a pair of end edges extending transversely therebetween, and upper and lower sides which face away from one another. A flange extends generally downwardly from the lower side of the top and has a pair of transversely spaced longitudinal sections. A pair of elongate rails are positioned adjacent the respective longitudinal sections of the flange and are secured to the lower side. A pair of leg assemblies are connected to the top at the lower side thereof which are pivotable relative to the top into a generally upright position to support the top in spaced relationship above a support surface such as a floor. The leg assemblies each include a brace arrangement associated therewith for rigidly supporting the leg assembly in the upright position, and each brace arrangement is pivotally connected to an elongate shaft which extends transversely between the opposed rails.

Still another aspect of the invention relates to a table including a horizontally enlarged, one-piece, monolithic plastic top which has a pair of longitudinal edges joined by a pair of end edges extending transversely therebetween, and upper and lower sides which face away from one another. A pair of elongate rails are secured to the lower side and extend longitudinally therealong adjacent the respective longitudinal edges, and a pair of leg assemblies are connected to the top at the lower side thereof. The leg assemblies are pivotable relative to the top between a generally upright position and a folded position adjacent the lower side. Each leg assembly includes an elongate and pivotable mounting shaft which extends transversely between the rails, and a base leg connected to the mounting shaft for engagement with a support surface such as a floor. The table also includes a longitudinally extending rib which is cantilevered outwardly from the lower side of the top, which rib defines thereon a handle member disposed generally centrally on the lower side for manipulating the table during transport thereof.

Other objects and purposes of the invention will be apparent to persons familiar with structures of this general type upon reading the following specification and inspecting the accompanying drawings.

Figure 1:
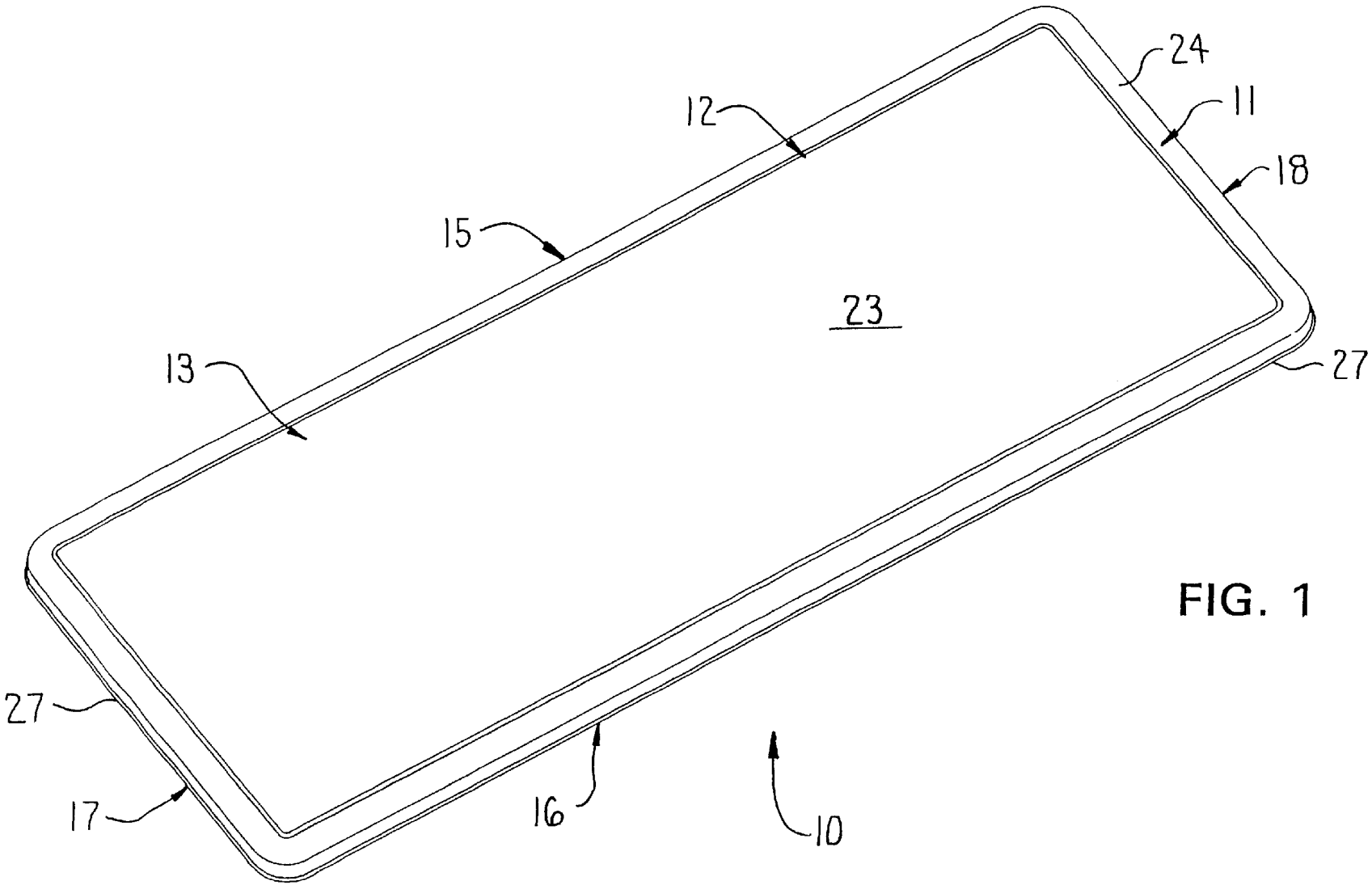
FIG. 1 is a top perspective view of the table according to the invention with the leg assemblies thereof in a folded configuration.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to the drawings, and specifically FIGS. 1–4, there is illustrated a portable table 10 according to the present invention. The table 10 includes a generally horizontally enlarged and rectangular top part 11, preferably a monolithic one-piece plastic part as described hereinafter. A securing structure 70 is attached to the underside of the top part 11 for providing both longitudinal reinforcement of the top part 11 and attachment of a pair of folding leg assemblies 20 which are swingably movable between a storage position wherein they directly underlie the top part and an upright or use position wherein they project downwardly from adjacent opposite ends of the top part for supportive engagement with a floor, which latter position is illustrated by dotted lines in FIGS. 2 and 3.

Considering initially the top part 11, it includes a generally horizontally enlarged and rectangular plate-like top wall 12 having upper and lower sides 13 and 14, respectively. The top wall 12 has a pair of generally parallel longitudinally extending side edges 15 and 16 which are joined together by generally parallel end edges 17 and 18 which extend generally perpendicularly between the side edges 15 and 16.

Figure 7:
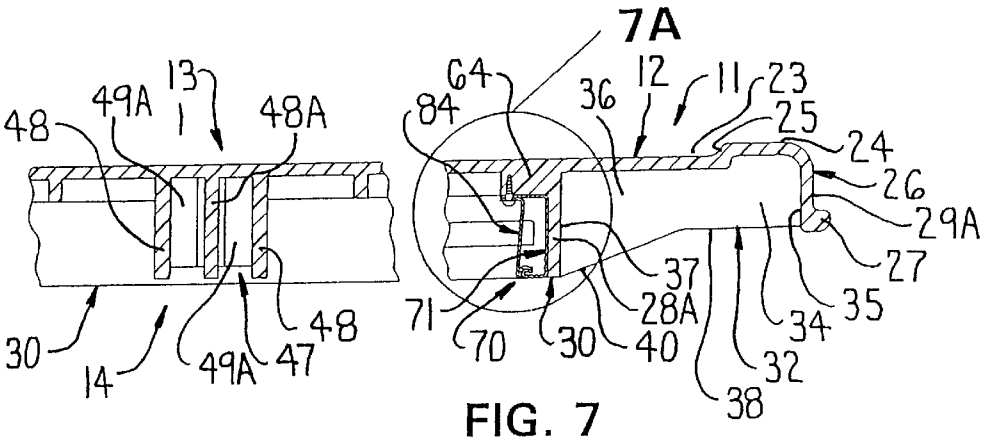
FIG. 7 is an enlarged, fragmentary, cross-sectional view taken generally along line 7—7 in FIG. 4.

As illustrated in FIGS. 1 and 7, the upper side 13 of top wall 12 is defined by an enlarged, center and generally rectangular upper surface 23 which is surrounded by a raised ring-shaped perimeter or peripheral upper surface 24. When the table 11 is in use, a ridge 25 defined between areas 23 and 24 serves as a spill-proof or roll-proof edge to confine materials on upper side 13.

Figure 5:
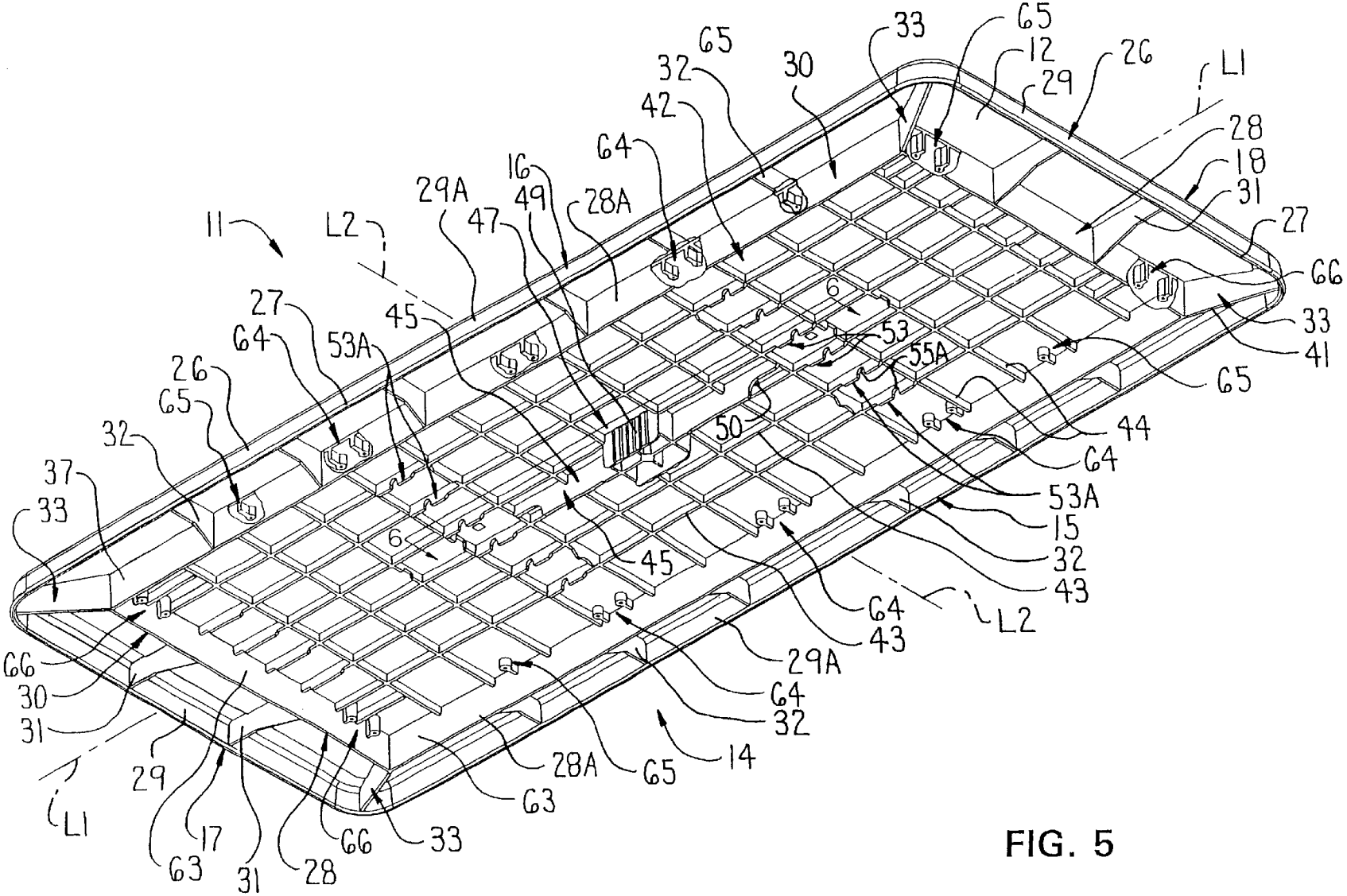
FIG. 5 is a perspective view similar to FIG. 4, but showing the one-piece top without the leg assemblies and securing structures associated therewith.

Referring to FIGS. 5 and 7, the longitudinal and end edges of top wall 12 are defined by and joined to an outer rectangular edge wall 26 which projects transversely (downwardly when the table is in use) from top wall 12 and terminates at its lower free edge in a lip or flange 27. Lip 27 projects generally horizontally outwardly a small distance from the respective edges 15–18 and extends about substantially the entire perimeter part of top part 11.

Figure 2:
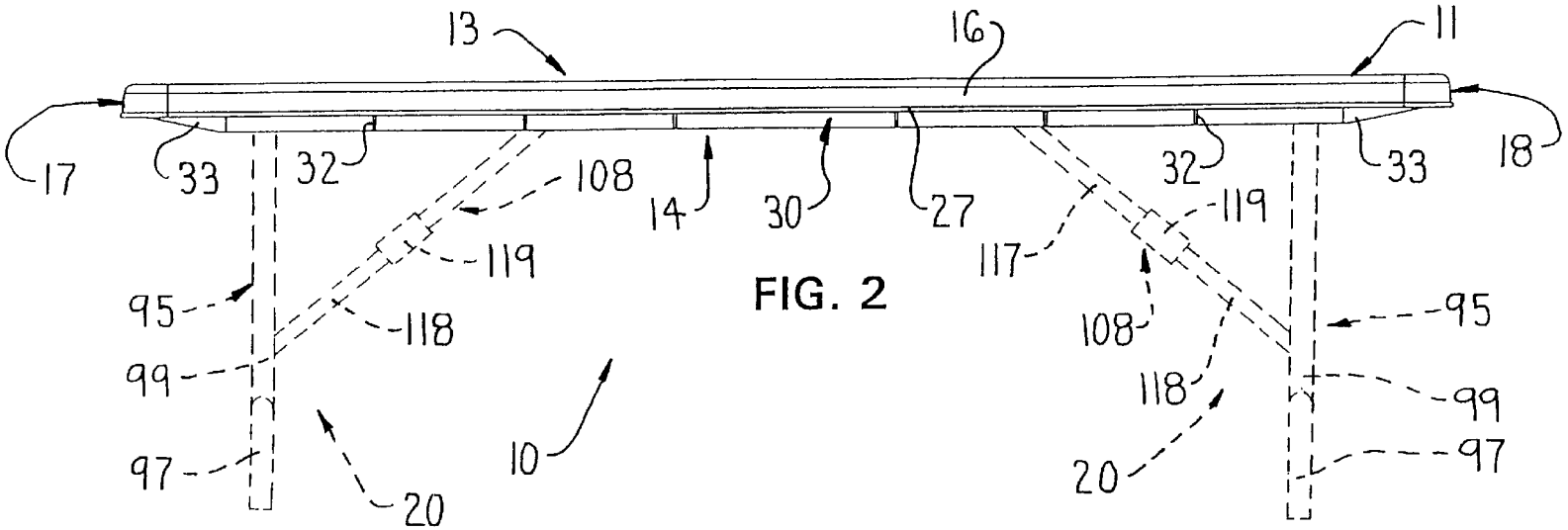
FIG. 2 is a longitudinal side view thereof with the respective leg assemblies in upright positions as shown in dotted lines.
Figure 3:
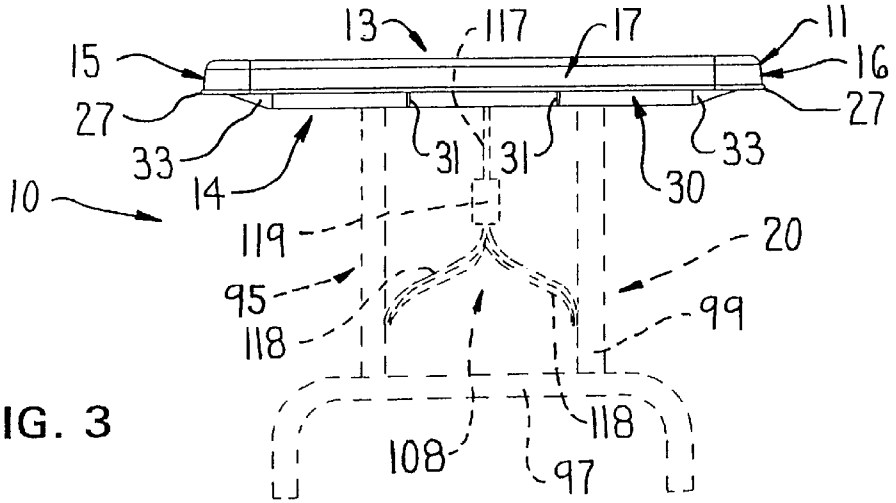
FIG. 3 is an end view thereof with the respective leg assemblies in upright positions as shown in dotted lines.

A rectangular main flange or wall 30 is spaced inwardly from, and extends in a generally parallel manner with respect to, edge wall 26. As shown in FIGS. 2, 3 and 7, main flange 30 projects downwardly beyond the lower lip 27.

Figure 4:
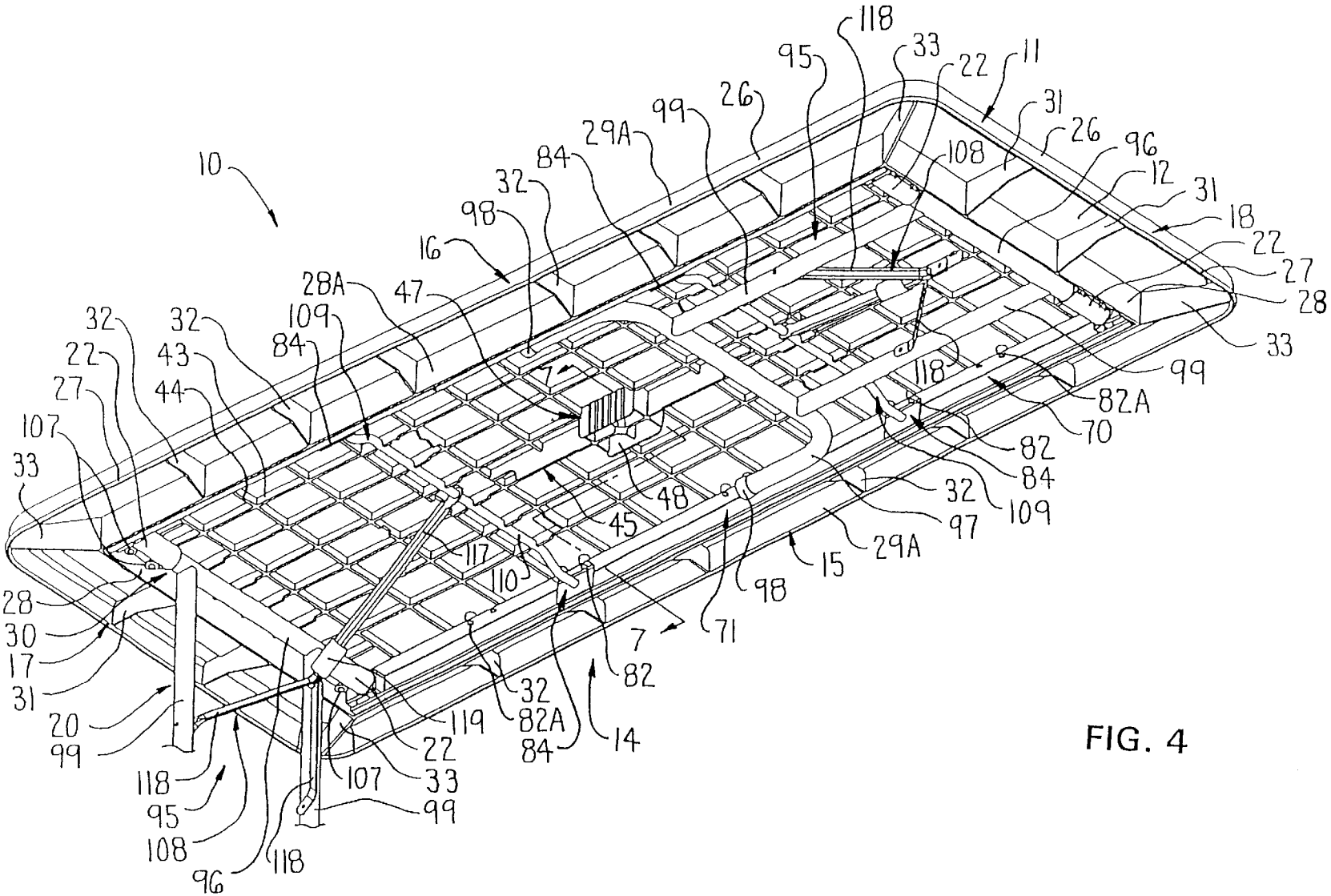
FIG. 4 is a fragmentary perspective view of the underside of the table of FIG. 1, with one leg assembly shown in the upright position.

With reference to FIGS. 4 and 5, the two transversely extending wall sections 28 of main flange 30 are connected to the respective opposed transverse wall sections 29 of edge wall 26 by a plurality (here two) of sidewardly-spaced cross ribs 31 extending transversely therebetween. Similarly, the two longitudinally extending wall sections 28A of main flange 30 are connected to the respective opposed longitudinal wall sections 29A of edge wall 26 by a plurality of sidewardly-spaced cross ribs 32 extending transversely therebetween. Cross ribs 31 are slightly greater in length than cross ribs 32 since, in the illustrated embodiment, the distance defined between the transverse wall sections 28 of main flange 30 and the respective transverse wall sections 29 of edge wall 26 is slightly greater than the distance defined between the longitudinally extending wall sections 28A of main flange 30 and the respective longitudinal wall sections 29A of edge wall 26. The corners of the main flange 30 are each connected to a rounded corner of edge wall 26 by a corner rib 33 extending therebetween.

As shown in FIGS. 4, 5, and 7 each rib 31–33 is connected to and projects downwardly from top wall 12 and extends between the opposed upright surfaces of edge wall 26 and main flange 30. More specifically, in the illustrated embodiment, the cross ribs 31 and 32 each have an outer generally vertical flat part 34 connected to the inwardly facing upright surface 35 of edge wall 26 and an inner generally vertical flat part 36 connected to the outwardly facing upright surface 37 of main flange 30. The outer part 34 is of a height similar to the height of edge wall 26 and terminates in a generally horizontally oriented free edge 38. Inner part 36 terminates in an angled free edge 40 which extends between outer part 34 and surface 37 of main flange 30. The portion of free edge 40 immediately adjacent and adjoining main flange 30 has a height similar thereto.

The corner ribs 33 extend diagonally between surfaces 35 and 37 defined at the corners of the respective edge wall 26 and main flange 30. Further, each corner rib 33 has a substantially smooth and continuous free edge 41 which in FIG. 5 angles downwardly from surface 35 of edge wall 26 as same extends toward surface 37 of main flange 30. As shown in FIGS. 2 and 3, the extension of main flange 30 downwardly beyond lower lip 27 and the angled configuration of the ribs 31–33 provide table part 11 with a generally tapered profile when viewed from the side.

Top part 11 also includes a plurality of reinforcing webs 42 arranged in a grid-like or lattice formation along the lower surface 14 (FIG. 5) of top wall 12. In the illustrated embodiment, the webs 42 extend over substantially the entire area of surface 14 as defined within main flange 30, and have a significantly smaller height than main flange 30. The grid-like formation of webs 42 includes a plurality of sidewardly-spaced longitudinally extending webs 43 which are generally parallel to the longitudinal wall sections 28A of main flange 30, and a plurality of sidewardly-spaced transversely extending webs 44 which are generally parallel to the transverse wall sections 28 of main flange 30. The webs 44 are arranged perpendicularly relative to webs 43 and thus divide the lower surface 14 of top 12 into a plurality of rectangular sections.

Top part 11 also includes an elongate and generally flat center wall 45 which is located on the lower surface 14 and is cantilevered downwardly (FIGS. 5 and 6) and terminates in a generally straight lower free edge 46 having a height less than the height of main flange 30. Center wall 45 extends lengthwise along the longitudinally extending centerline L1 of top member 11 so as to be spaced inwardly an approximately equal distance from each of the longitudinal wall sections 28A of main flange 30 and extends generally parallel thereto. In addition, center wall 45 is centered at the transversely extending centerline L2 of top member 11 and extends longitudinally equal distances toward the opposite ends of the top member, but terminates at one of the transverse ribs 44 which is disposed slightly less than midway between the centerline L2 and the adjacent wall section 28. The length of the center wall 45 in the illustrated embodiment is approximately slightly less than one-half of the length of the top 12 as measured between the end edges 17 and 18.

Figure 6:
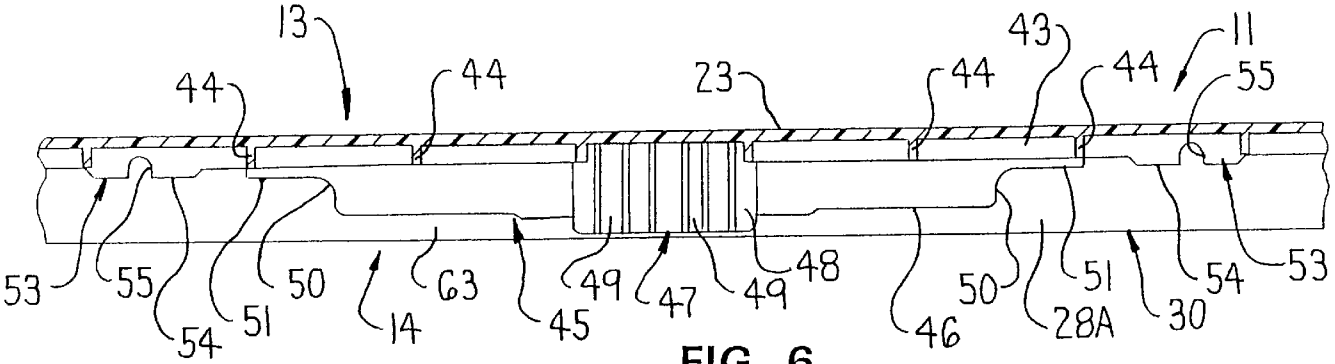
FIG. 6 is an enlarged, fragmentary cross-sectional view taken generally along line 6—6 in FIG. 5.

Center wall 45, approximately midway therealong, includes a handle member 47. Handle member 47 is defined by a pair of longitudinally extending side walls 48 which project downwardly from top wall 12. Each side wall 48 is generally parallel to, and transversely spaced from, a middle section 48A of center wall 45. The height of free edge 46 adjacent middle section 48A is slightly greater than the remaining portions of edge 46, but is still less than the height of main flange 30 (FIG. 6). As shown in FIG. 6, the height of each of the side walls 48 is slightly greater than the height of middle section 48A and less than the height of main flange 30. Each side wall 48, on a side thereof which faces the respective longitudinal section 28A of main flange 30, defines thereon a plurality of arcuate recesses or finger grips 49 arranged in series with one another in the longitudinal direction of center wall 45. Side walls 48 and middle section 48A are connected to one another by a plurality (here three) of transversely extending web sections 49 which project downwardly from top wall 12. The two outermost web sections 49 are adjoined to respective transverse webs 44. Web sections 49A have approximately the same height as the middle section 48A of center wall 45.

Center wall 45 includes a pair of curved shoulders 50 which are defined in free edge 46 on opposite sides of handle member 47 at approximately equal distances therefrom. Center wall 45 terminates in a pair of ends 51 adjacent shoulders 50 which abut and are integral with a respective transverse web 44.

With continued reference to FIGS. 5 and 6, the two centermost longitudinal webs 43 which are positioned in straddling relation to center wall 45 each define thereon a pair of support plates 53 which project downwardly away from top wall 12 to a height approximately the same as the height of ends 51 of center wall 45. The support plates 53 associated with each web 43 are disposed in equally spaced relation on opposite sides of transverse centerline L2, and are positioned generally adjacent one end of the center wall 45. The lower free edge 54 of each plate 53 is generally straight and defines therein at a central location a semi-circular and downwardly-opening recess or channel 55.

The pairs of outermost longitudinal webs 43 on opposite sides of the respective support plates 53 and adjacent the respective ends 51 of center wall 45 define thereon additional support plates 53A with channels 55A. Support plates 53A are essentially identical to plates 53, and will therefore not be discussed in further detail. The channels 55 of support plates 53 and channels 55A of support plates 53A are aligned with one another in the transverse direction of top 12.

As shown in FIG. 5, a plurality of rail-mounting bosses are disposed on and project downwardly from lower side 14. The bosses project inwardly toward center wall 45 from an inner upright surface 63 of main flange 30 opposite outer upright surface 37 thereof. More specifically, three pairs of bosses 64 are located along both longitudinal wall sections 28A of main flange 30, and two single side bosses 65 are located on the respective wall section 28A on opposite sides of, and longitudinally spaced from, the respective pairs of bosses 64. The individual bosses of the two outer pairs of bosses 64 are longitudinally spaced from one another by a small distance and are oriented relative to support plates 53 and 53A such that an imaginary transverse vertical plane aligned with each of the channels 55 and 55A will intersect the main flange 30 generally centrally between the respective bosses 64. Further, the bosses 64 and 65 in the illustrated embodiment are of a height similar to the normal height of the webs 43 and 44.

Figure 7A:
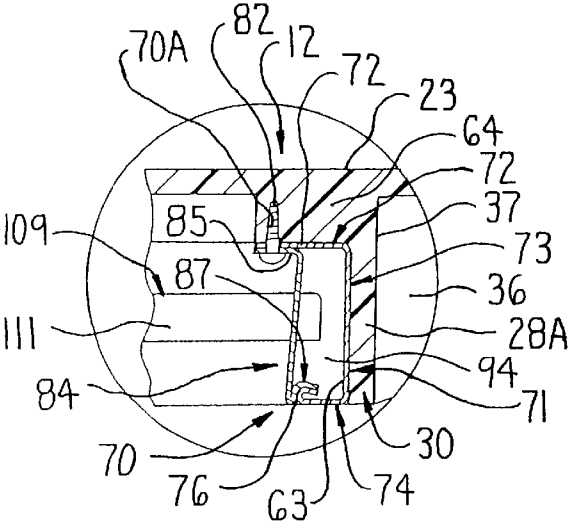
FIG. 7A is a detail view of FIG. 7.

Additional leg-mounting end bosses 66 are disposed on lower side 14 and project inwardly from the inner surface 63 of the respective transverse wall sections 28 of main flange 30. As shown in FIG. 5, two pairs of such bosses 66 are positioned along each wall section 28. The respective pairs of bosses 66 are spaced from one another in the transverse direction of top 12 and are positioned adjacent the corners of main flange 30. Leg-mounting bosses 66 are similar in configuration to rail-mounting bosses 63 and 64, and all of the bosses 64, 65 and 66 define therein a downwardly opening mounting hole 70A (See FIG. 7A).

It will be appreciated that top member 11 including the structures described above and illustrated in FIG. 5 such as top wall 12, edge wall 26, main flange 30, ribs 31–33, webs 43 and 44, center wall 45 and handle member 47, and bosses 64–66 are formed as an integral, monolithic, one-piece plastic component.

Considering now the securing structure 70, as shown in FIG. 4, this structure 70 includes a pair of elongate and generally L-shaped rigid rails 71 which are mounted on top member 11 at the lower side 14 thereof along the respective longitudinal wall sections 28A of main flange 30. The rails 71 are identical to one another and therefore only one of such will be described herein and is shown in FIG. 8.

The rail 71 includes a flat main leg 72, an upright side leg 73 joined to and extending generally perpendicularly from one longitudinal edge of main leg 72, and a generally J-shaped base leg 74 opposite main leg 72. Base leg 74 is joined to a longitudinal edge of side leg 73 and has a generally flat section 75 which is generally parallel to main leg 72. Flat section 75 of base leg 74 terminates in a curved portion 76 which first curves upwardly toward main leg 72 and then curves away therefrom and back toward an inner or upwardly facing surface of flat section 75. As shown in FIG. 7, the width of the flat section 75 of base leg 74 (as measured in the transverse direction of top wall 12) is less than the width of main leg 72, and in the illustrated embodiment is approximately one-half of the width of main leg 72. The length of rail 71 is approximately equal to the longitudinal distance defined between the opposed inner surfaces 63 of the respective transverse wall sections 28 of main flange 30.

Figures 8, 9:
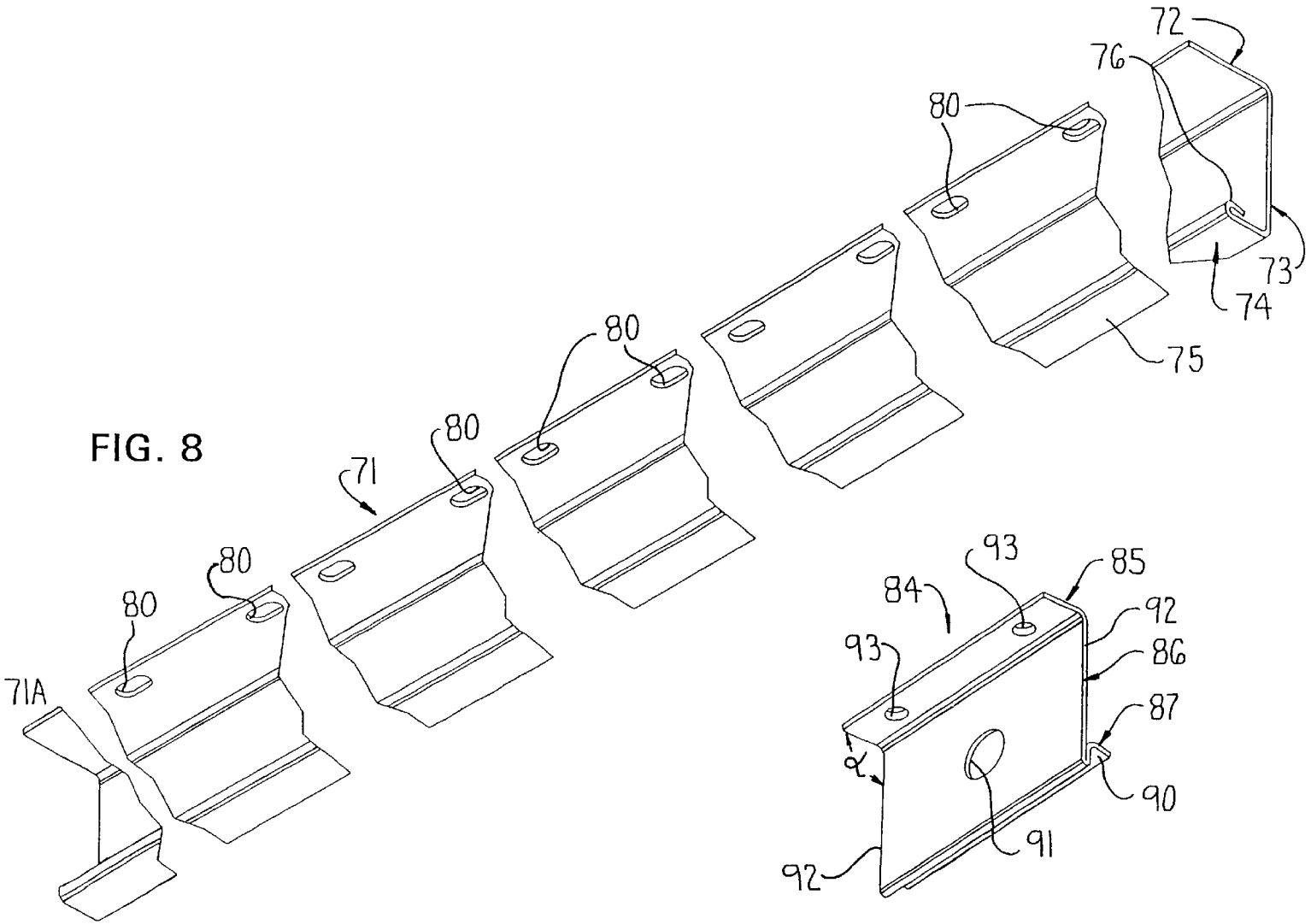
FIG. 8 is an enlarged, fragmentary perspective view of a reinforcing rail.
FIG. 9 is an enlarged, perspective view of a pivot shaft bracket.

As best shown in FIG. 8, main leg 72 defines therein a plurality of holes 80 which extend therethrough. The location of each of the holes 80 along rail 71 corresponds to the location of holes 70 of the respective bosses 64 and 65 formed adjacent the respective longitudinal wall sections 28A of main flange 30.

Referring now to FIGS. 4, 7 and 9, the securing structure 70 also includes a pair of generally Z-shaped brackets 84 provided along each of the longitudinal wall sections 28A of main flange 30 adjacent the inner surface 63 thereof. Brackets 84 are identical to one another and therefore only one bracket will be described herein.

The bracket 84 has a generally flat top flange section 85, an intermediate generally upright and flat section 86 which is connected to a longitudinal edge of top flange section 85, and a lower lip 87. As shown in FIG. 9, intermediate section 86 and flange section 85 together define an angle $\alpha$ slightly less than 90°, and in the illustrated embodiment, sections 85 and 86 define an angle $\alpha$ of about 86°. Lip 87 is connected to a longitudinal edge of intermediate section 86 and has a curved, trough-like configuration defining an abutment surface 90 having a shape which is complementary or corresponds to the shape of curved portion 76 of rail 71.

As shown in FIG. 9, intermediate section 86 defines therein a circular hole 91 located at an approximately equal distance from each of the upright end edges 92 of section 86, and approximately midway between flange section 85 and lip 87. Further, flange section 85 defines therein a pair of holes 93 which are spaced from one another by a distance which corresponds to the distance defined longitudinally between the holes of each of the respective pairs of holes 80 of the rails 71 and the corresponding bosses of the pairs of bosses 64 of top part 11.

The rails 71 are mounted to the lower side 14 of top wall 12 so that the main leg 72 thereof is superimposed on the respective bosses 64 and 65, and so that the side leg 73 is superimposed on the inner surface 63 of the respective longitudinal wall section 28A of main flange 30 (FIG. 7). The base legs 74 of the respective rails 71 thus project inwardly and toward one another when the rails 71 are positioned on top part 11 in the above manner. Further, each rail 71 when mounted on top part 11 defines an inwardly opening channel 71A. Next, two brackets 84 are positioned on each rail 71 so that the flange section 85 thereof is superimposed upon the main leg 72 of the respective rail 71 and the holes 93 are aligned with the corresponding holes 80, and so that the curved abutment surface 90 is positioned in contact with the curved portion 76 of rail 71. Fasteners, such as screws 82, are then inserted into the aligned holes 80 and 93 of rail 71 and bracket 84, respectively, and are screwed into the corresponding holes 70A of bosses 64. An additional fastener 82A (See FIG. 4) is also inserted into each hole 80 located closest to each terminal end of the respective rail 71 and screwed into the corresponding hole 70A of side boss 65. The rails 71 and brackets 84 are now fixed to the lower surface 14 of top wall 12.

As shown in FIG. 7, each bracket 84 (when mounted to the respective rail 71 in the manner discussed above) and the corresponding opposed side leg 73 of the rail 71, are horizontally spaced from one another so as to define a channel or space 94 therebetween.

In the illustrated embodiment, rails 71 and brackets 84 are constructed of metal.

Turning now to the two leg assemblies 20, same are substantially identical to one another and therefore only one leg assembly will be described herein.

Leg assembly 20 includes a leg 95 defined by an elongate and generally cylindrical top leg member 96, a generally U-shaped and cylindrical base leg member 97 having suitable feet 98 secured to the terminal ends thereof, and a pair of generally parallel cross members 99 which are fixed to and extend between leg members 96 and 97.

Figure 11:
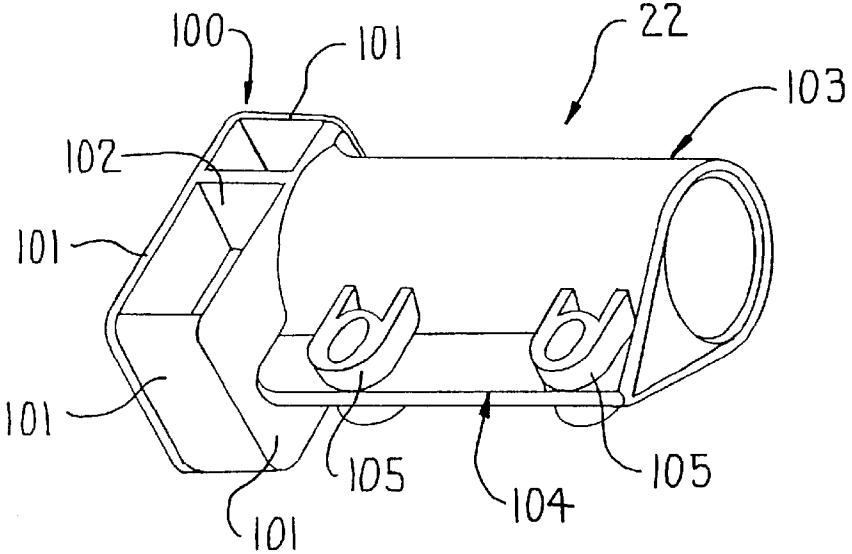
FIG. 11 is a further enlarged perspective view of a leg socket.

The top leg member 96 of each leg assembly 20 is secured to top member 11 via a pair of mounting sockets or sleeves 22. The mounting sockets 22 are identical to one another, and only one of which will be discussed herein with reference to FIG. 11. Mounting socket 22 includes a block-like end part 100 having four side walls 101 arranged in a rectangular fashion which together define a hollow interior of end part 100. A reinforcing partition or wall 102 extends between two opposed longitudinal side walls 101. Mounting socket 22 additionally includes a tubular member 103 which is closed at one end and adjacent this closed end is fixed to and projects sidewardly from end part 100. A mounting flange 104 is provided axially along the outer surface of tubular member 103 and defines thereon a pair of mounting elements or bosses 105 which are spaced apart from one another by a distance which corresponds to the distance defined transversely between the holes 70 of the individual leg-mounting bosses 66 of each boss pair 66 provided on the lower side 14 adjacent the respective corners of main flange 30. The mounting elements 105 each define therein a through hole 106.

As shown in FIG. 4, a pair of mounting sockets 22 are assembled onto each top leg member 96 by inserting the terminal ends thereof into the respective tubular members 103 so that the block-like end parts 100 are disposed outwardly. The transverse length of top leg member 96 with the respective sockets 22 assembled thereon is similar to or slightly less than the distance defined transversely between the inner ends of base legs 74 of the opposed rails 71 so as to allow insertion of the end parts 100 into the channel 71A (FIG. 8) defined between the main and base legs 72 and 74 of the respective rail 71. The holes 106 of the mounting bosses 105 are then aligned with the corresponding holes 70A of the respective pairs of leg-mounting bosses 66 provided on top member 11 by sliding the sockets 22 relative to the respective terminal ends of mounting leg 96 towards the respective rail 71 so that the block-like end parts 100 engage between the main and base legs 72 and 74. Threaded fasteners 107 (FIG. 4) are then inserted into holes 106 of mounting bosses 105 and screwed into holes 70A of the corresponding bosses 66.

It will be appreciated that the interior diameter of tubular member 103 is of a size sufficient to allow top leg member 96, and hence the respective leg 95, to rotate or pivot relative thereto generally about the longitudinal axis of the top leg member 96 which axis extends horizontally transversely relative to the top member 11. This pivoting movement of each leg assembly 20 is limited by a strut arrangement 108. Each strut arrangement 108 cooperates with a rigid, elongate and generally cylindrical pivot shaft or journal 109 mounted adjacent the lower side 14 of top member 11.

Figure 10:
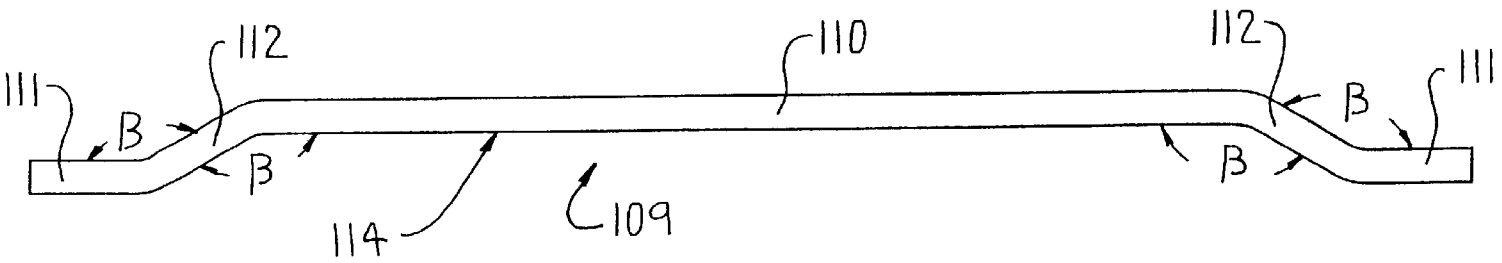
FIG. 10 is an enlarged view of a pivot shaft.

The two pivot shafts 109 are substantially identical to one another and only one such shaft will be described herein. As shown in FIG. 10, pivot shaft 109 has a straight central part 110 and two end parts 111 arranged on opposite sides of central part 110. End parts 111 are joined to respective ends of central part 110 via angled sections 112. The end parts 111 are coaxial with one another. In the illustrated embodiment, the angled sections 112 and central part 110 together define an angle $\beta$ which is about 140° to about 155°, and in the preferred embodiment is about 150°. Likewise, angled sections 112 and the adjacent respective end parts 111 together define angle $\beta$.

The pivot shafts 109 are secured to the lower surface 14 of table part 11 by inserting one end part 111 thereof into hole 91 of bracket 84 and into channel 94 a sufficient distance to allow the other shaft end 111 to be inserted into the hole 91 of the opposite bracket 84. The pivot shaft 109 is positioned on lower side 14 so that the central part 110 thereof is disposed within the channels 55 and 55A of the respective support plates 53 and 53A. The configuration of the pivot shafts 109 results in a shallow recess 114 (FIG. 10) located between end parts 111 of shaft 109. This recess 114 receives therein the cross members 99 of the corresponding leg 95 as discussed below.

Turning now to the strut arrangement 108 associated with each leg assembly 20, same is of a conventional construction and will therefore be only briefly discussed herein. Each strut arrangement 108 includes a center brace 117 which at one terminal end thereof is pivotally connected to central part 110 of pivot shaft 109, and a pair of links 118 are in turn pivotally connected to the opposite end of brace 117. The outer terminal ends of links 118 are pivotally connected to the inwardly facing sides of the respective cross members 99 of the respective leg 95. A conventional locking tube 119 is provided on center brace 117 to hold leg assemblies 20 in the erect or upright position as illustrated on the left in FIG. 4 (and in dotted lines in FIGS. 2 and 3).

In the folded position of leg assemblies 20, the cross members 99 are positioned within the shallow recess 114, the central portion of base leg 97 is positioned against the shoulder 50 of center wall 45, and the terminal ends of the base leg 97 are positioned along the main leg 72 of the respective rails 71. The leg assemblies are retained or held in the folded position via friction in the strut arrangement 108.

As shown in FIGS. 2 and 3, main flange 30 projects downwardly past the folded leg assemblies 20 so that same are not visible from the side, that is, the folded leg assemblies 20 nest within the cavity defined by main flange 30. In addition, with the leg assemblies 20 in the folded position, the table 10 can be easily carried by placing the upper side 13 of the table against the side or torso so that the lower side 14 faces outwardly, and positioning the fingers in the finger grips 49 of the handle member 47. In this regard, the positioning of handle member 47 as discussed above allows the person carrying the table 10 to hold the carrying arm in an extended or straight position which can reduce arm and shoulder strain.

With the improved table 10 of this invention, the leg assemblies when in the folded or closed position as illustrated in FIG. 4 effectively nest entirely within the rectangular cavity defined by the rectangular main flange 30, and thus a plurality of like folded tables can be readily stacked on top of one another without encountering interference or damage from the legs. For example, when like tables are stacked, the free edge of the rectangular main flange 30 of one table will directly vertically engage an opposed upper surface 23 of the next vertically stacked table so that the stacked tables have plastic-to-plastic contact, thereby providing not only stability in stacking, but also preventing the leg structures from contacting and marring the top of the adjacent table. Further, in the stacked relationship, the rectangular main flange 30 of one table effectively engages the upper surface 23 of the adjacent table, whereby the main flange 30 is thus positioned within the ridge 25 of the adjacent table, thereby creating a partial nesting between the stacked tables in that the ridge 25 of one table effectively resists any tendency of the opposed engaged table from sliding laterally out of supportive engagement therewith.

In addition, the overall one-piece monolithic plastic construction of the top part 11, and specifically the construction of the main flanges 30 associated with the underside of the top part and the cooperation with the pair of longitudinal rails 71, provides the top part 11 with significant strength, particularly longitudinally, so as to permit application of significant loads thereto without creating excessive deflection (i.e. bowing) of the top part 11 when in an upright use condition. In this regard, the significant thickness in vertical cross-section of the longitudinally extending wall sections 28A of the main flange 30, coupled with the strength provided by the channel-shaped cross-section of the metal side rails 71 which extend along the inner sides of the wall sections 28A, provide beam-like constructions which extend longitudinally along opposite side portions of the top part 11 so as to provide the top part with significant strength and resistance against deflection or bowing due to application of significant vertical loads on the upper surface thereof.

The strength of the top part is further enhanced by the presence of the center wall 45 which also extends longitudinally substantially along or adjacent the longitudinal center line 4 of the table, which center wall 45 also has a substantial thickness and a substantial vertical height which, when coupled with the fact that it extends longitudinally from the transverse center line of the table in opposite directions approximately one-half the distance towards each end of the table, thus provides additional strength and rigidity to the table, particularly in the longitudinal center portion thereof, to provide further strength and resistance to bowing. At the same time this center wall 45 also provides the highly convenient and added function of providing a handle portion which can be conveniently grasped from either side of the table 10 so as to facilitate manual handling and transport thereof when the top part 11 is in a vertically oriented position.

The top part in the illustrated embodiment is constructed of plastic formed via a conventional structural foam molding process including low-pressure injection molding with a foaming agent to reduce the density of top part 11. In this regard, top part 11 may be constructed of modified polypropylene (or polyethylene) with an additive to improve impact resistance. The top part 11 as formed via the above process and materials is lightweight yet rigid and durable.

Edge wall 26 has a vertical height in the range of about 1¼ and 2¼ inches, and in the illustrated embodiment about 1¾ inches. Further, main flange 30 has a vertical height in the range of about 2 and 3 inches, and in the illustrated embodiment about 2½ inches and projects downwardly beyond edge wall by a distance of about ¾ inch. The approximate normal vertical height of webs 43 and 44 and top wall 12 in the illustrated embodiment is about ¼ inch, and the average wall thickness of top part 12, edge wall 26, main flange 30 and center wall 45 is about ¼ inch.

Further, in use (i.e. with leg assemblies 20 in the extended and upright positions) the configuration of top 12 according to the invention is such that the main flange 30 bears the load, and forces exerted on the outer perimeter of top part 11 are transferred from edge wall 26 to main flange 30 and rails 71 via ribs 31, 33. Further, loads imposed on top part 11 are transferred through flange 30 to rails 71, which rails in turn permit effective transfer of loads to the supporting leg assemblies.

The table 10 illustrated in FIGS. 1–4 may be provided in varying lengths, and in the illustrated embodiment has a length of approximately six feet as measured between end edges 17 and 18.

Figure 12:
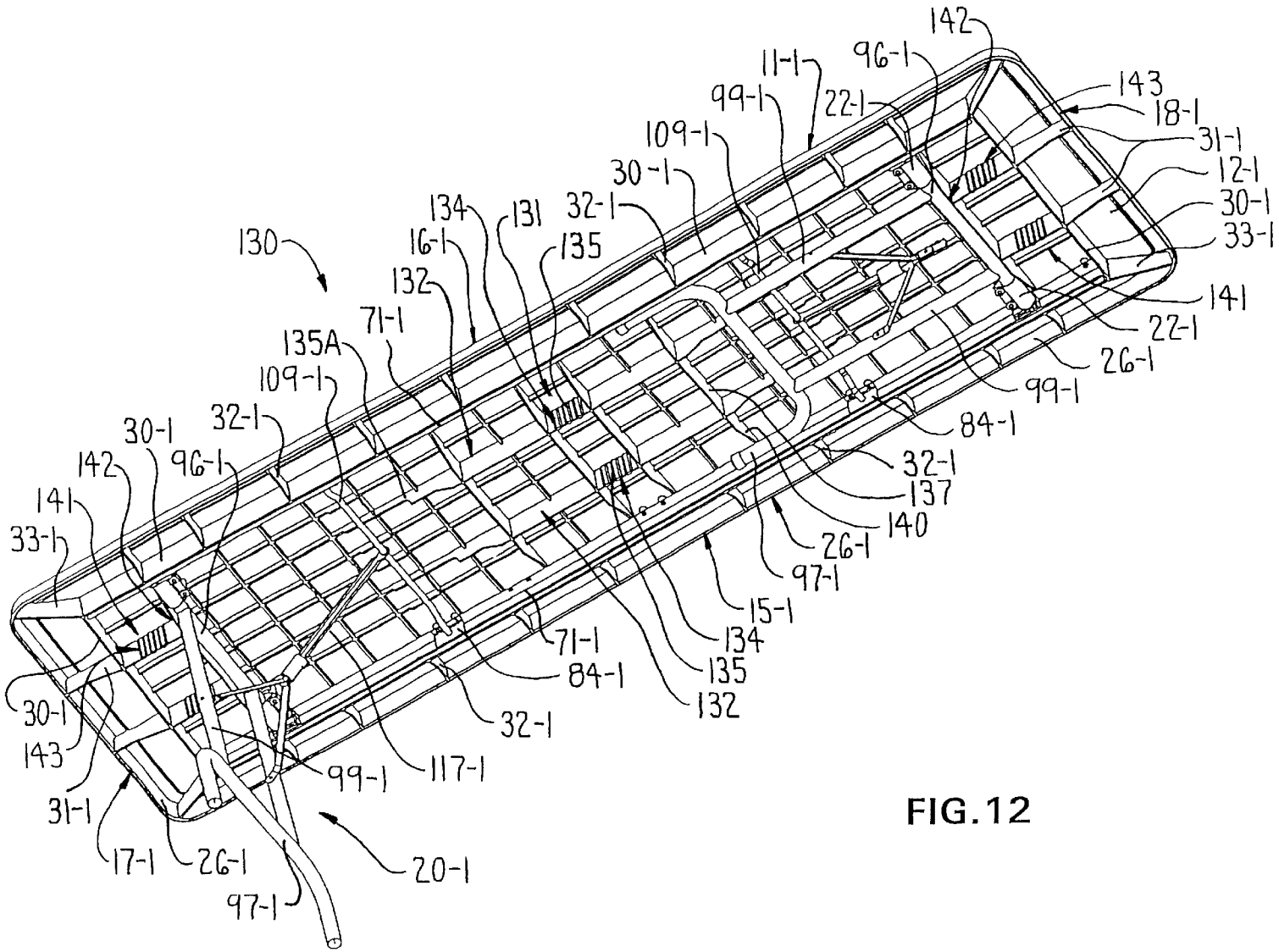
FIG. 12 is a fragmentary perspective view of the underside of a table according to an additional embodiment of the invention, with one leg assembly shown in the upright position.
Figure 13:
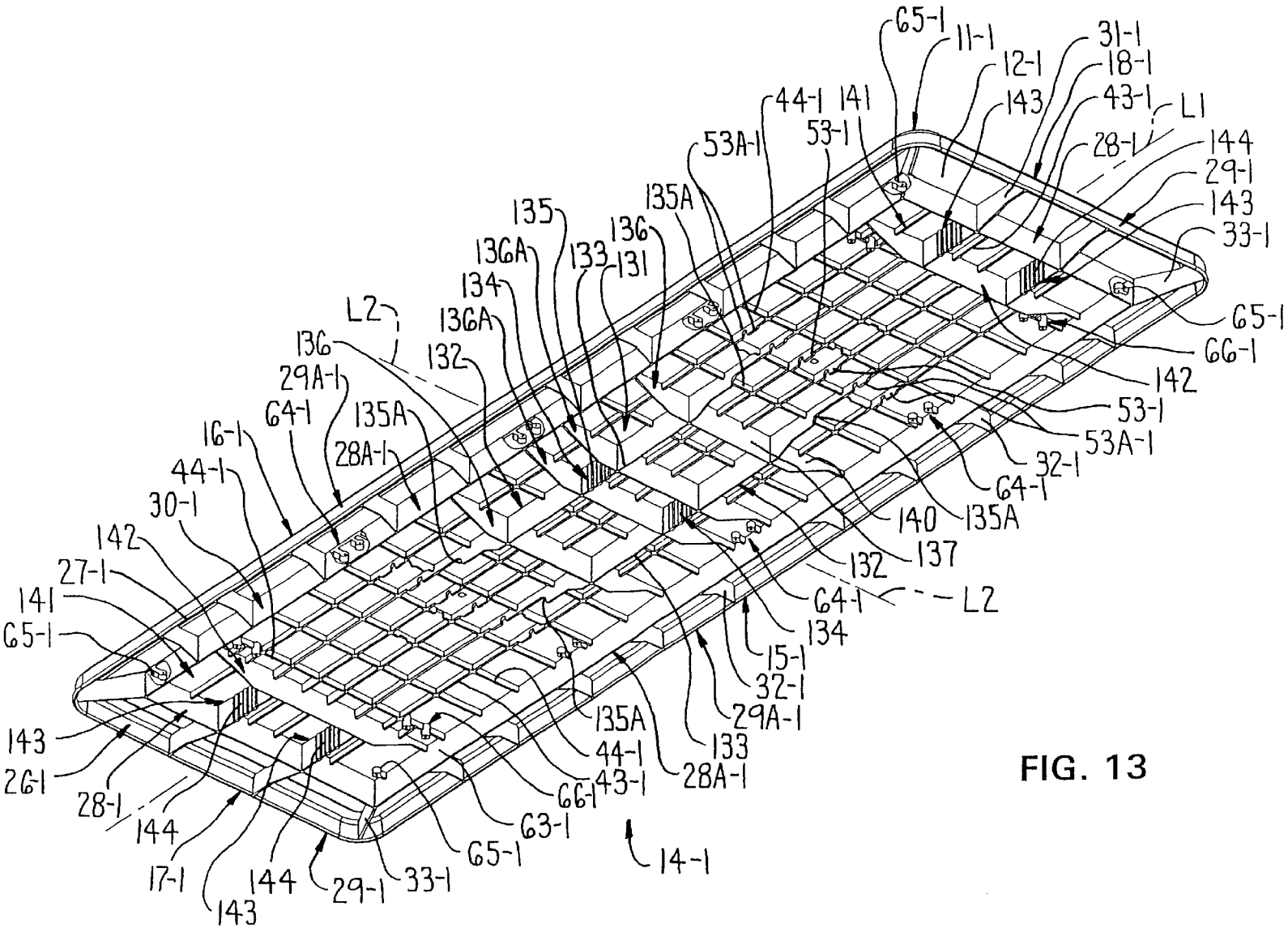
FIG. 13 is a perspective view similar to FIG. 12, but showing the one-piece top without the leg assemblies and securing structures associated therewith.

FIGS. 12 and 13 illustrate a variant of the table according to the invention, and specifically a table 130 which includes a modified center wall and handle arrangement, and also includes additional wall and handle arrangements adjacent each of the ends of table 130. Since the table 130 is similar in configuration to table 10 discussed above, the same reference numbers plus a "-1" are therefore utilized to depict the same or similar components.

It will be appreciated that the modified handle and wall arrangements of table 130 shown in FIGS. 12 and 13 are adapted for a table having a greater longitudinal length than the table 10 of FIGS. 1–4, such as a table having a length of eight feet or more.

With reference to FIG. 13, table 130 includes a generally centrally located center wall and handle arrangement 131 embodied by a pair of elongate and longitudinally extending center walls 132 located on lower side 14-1 which are generally parallel to one another and are cantilevered downwardly and terminate in a generally straight lower free edge 133. Center walls 132 extend lengthwise along lower side 14-1 of top part 11-1 and are spaced at approximately equal distances from the longitudinally extending center line L1 of top part 11-1 and thus are also spaced at approximately equal distances from the respective longitudinal wall sections 28A-1 of main flange 30-1.

Each center wall 132, approximately midway therealong, includes a handle member 134 which defines on opposite sides thereof finger grips 135 similar to finger grips 49. The height of free edge 133 of center wall 132 adjacent handle member 134 is similar to, but slightly less than the height of main flange 30-1. Each center wall 132 also includes a pair of shoulders 135A (similar to shoulders 50) which are defined in free edge 133 on opposite sides of the respective handle member 134 at approximately equal distances therefrom. Center walls 132 extend longitudinally equal distances toward the opposite end edges 17-1 and 18-1 of top member 11-1 and terminate at and adjoin respective support plates 53A-1 adjacent the respective shoulders 135A.

The center walls 132 are connected to one another by a plurality (here four) of transversely extending walls 136 and 136A which project downwardly from top wall 12-1 and extend between the opposed longitudinal sections 28A-1 of main flange 30-1. Walls 136 and 136A each have a middle section 137 of approximately the same height as the free edge 133 of the respective center walls 132 and a pair of bevelled or tapered ends 140 which diverge toward top wall 12-1 and ultimately adjoin respective transverse webs 44-1. The walls 136A are located at approximately equal distances from the transverse center line L2 of top part 11-1 so as to straddle the respective handle members 134. The walls 136 are spaced from the handle members 134 and are positioned generally adjacent the respective shoulders 135A of center walls 132. The free edges 133 of the respective center walls 132, adjacent the location where the center wall 132 adjoins or crosses the respective wall 136, diverges or tapers toward top wall 12-1 and then projects in a generally horizontal manner towards shoulder 135A.

With continued reference to FIG. 13, table 130 includes a wall and handle arrangement 141 located generally adjacent each of the respective end edges 17-1 and 18-1. Each wall and handle arrangement 141 includes a transversely extending end wall 142 which is substantially identical to the walls 136, 136A described above. Each end wall 142 is spaced transversely inwardly from and is generally parallel to a respective transverse section 28-1 of main flange 30-1. A pair of generally straight handle sections 143 extend between and interconnect the each end wall 142 and the respective adjacent transverse main flange section 28-1. Each handle section 143 extends in the lengthwise direction of top part 11-1 and defines on opposite sides thereof finger grips 144 similar to finger grips 135. The pair of handle sections 143 at each end of top part 11-1 are located at approximately equal distances from longitudinal center line L1 and straddle the two centermost longitudinally extending webs 43-1.

In the embodiment shown in FIGS. 12 and 13, rails 71-1 are provided on top part 11-1 and have a length which generally corresponds to the distance defined longitudinally between the respective transverse sections 28-1 of main flange 30-1. The rails 71-1 and accompanying pivot shaft brackets 84-1 are secured to top part 11-1 via bosses 64-1 and 65-1 as discussed above. Further, the leg assemblies 20-1 are secured to top part 11-1 so that top leg member 96-1 extends along a respective end wall 142, and the terminal ends of top leg member 96-1 are secured to top wall 12-1 via mounting sockets 22-1 and leg mounting bosses 66-1 located along the respective transverse web 44-1 nearest end wall 142. As discussed above, the block-like end parts of the respective sockets 22-1 nest within the channel defined between the main and base legs of the respective rail 71-1.

In use, the table 130 can be easily carried by placing the upper side 13-1 thereof against the side or torso so that the lower side 14-1 faces outwardly, and utilizing the lowermost handle member 134. Due to the particular symmetrical configuration of wall and handle arrangement 131 relative to longitudinal center line L1, the table 130 can be easily positioned for carrying with either longitudinal edge 15-1 or 16-1 uppermost. Further, the wall and handle arrangements 141 located at each end of table 130 permit easy handling of table 130 by two or more persons.

The wall and handle arrangements 131 and 141 of table 130 also function as reinforcing structures adjacent the center and ends of the table 130, respectively, which improves overall structural rigidity and load-bearing capability.

The handle arrangements 47, 134 and 143 are desirable for handling and transporting of the collapsed tables inasmuch as they enable an individual carrying the table to vertically extend or straighten the carrying arm to lessen arm strain.

Figure 14:
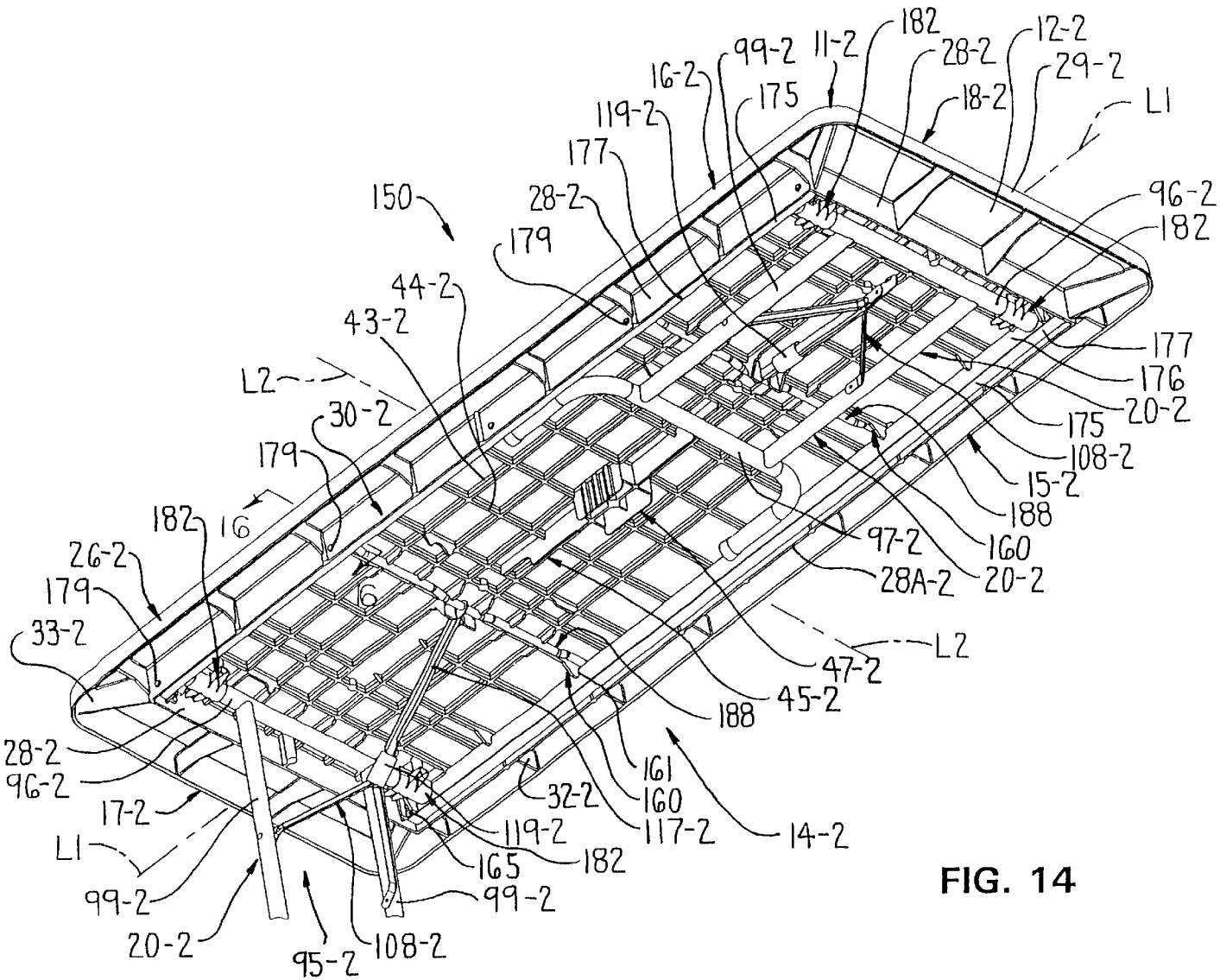
FIG. 14 is a fragmentary perspective view of the underside of a table according to an additional preferred embodiment of the invention, with one leg assembly shown in the upright position.
Figures 15, 16:
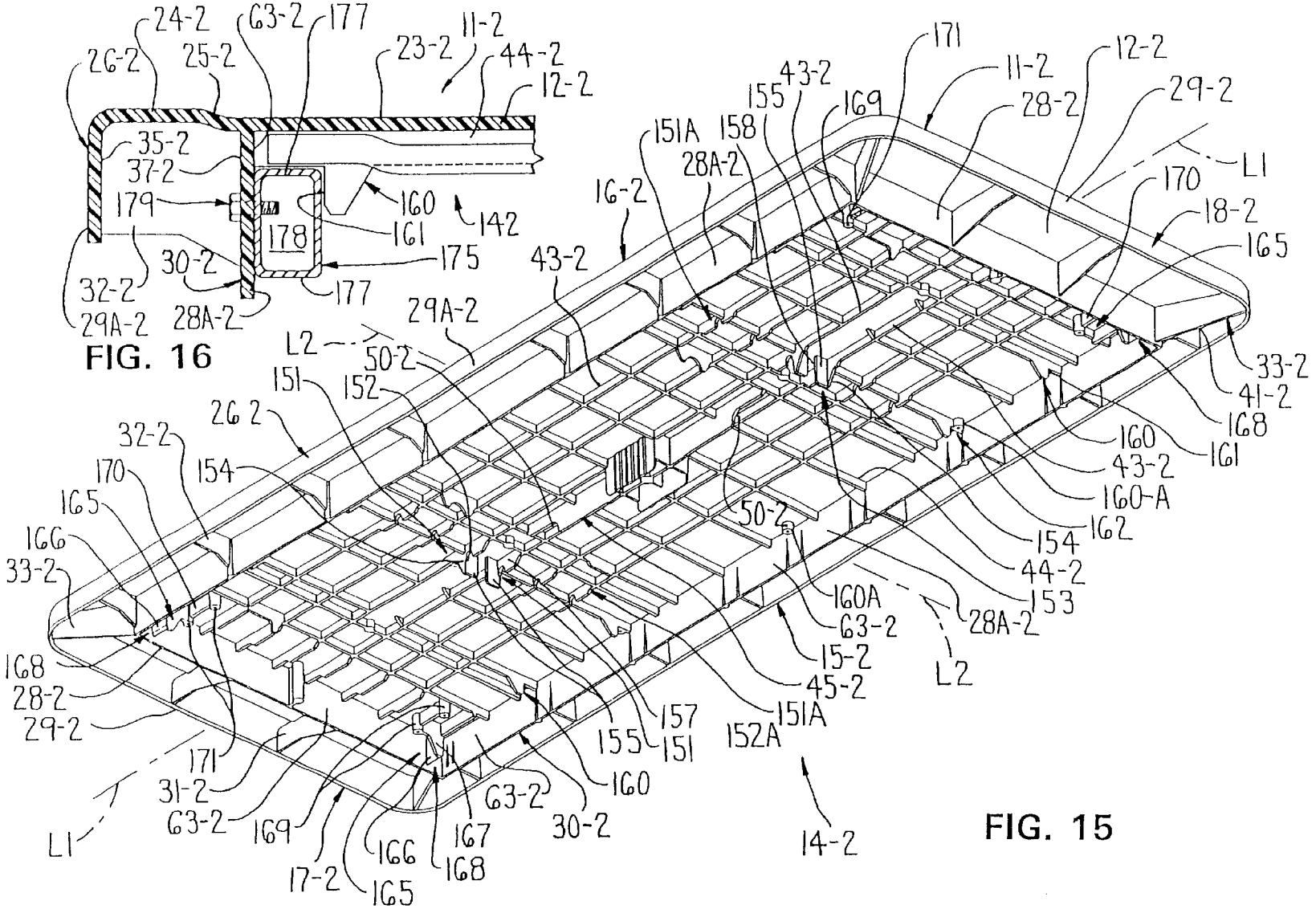
FIG. 15 is a perspective view similar to FIG. 14, but showing the one-piece top without the leg assemblies and securing structures associated therewith.
FIG. 16 is an enlarged, fragmentary, cross-sectional view taken generally along line 16—16 in FIG. 14.

FIGS. 14 and 15 illustrate a preferred variant of the table according to the invention, and specifically a table 150 which includes a modified rail and leg mounting arrangement. Since the table 150 is similar in configuration to table 10 discussed above, the same reference numbers plus a "-2" are utilized to depict the same or similar components. Further, these same or similar components are not discussed below in detail except in relation to modified structures of table 150.

With reference to FIGS. 14 and 15, the two centermost longitudinal webs 43-2 which are positioned in straddling relation to center wall 45-2 each define thereon a pair of central support plates 151 which project downwardly from top wall 12-2. The respective pairs of central support plates 151 associated with each web 43-2 are disposed in equally spaced relation from one another on opposite sides of transverse centerline L2, and each pair of support plates 151 is positioned generally adjacent one end of the center wall 45-2. Each support plate 151 defines therein at a central location a downwardly opening, generally semi-circular recess 152. A vertically oriented upright 153 is positioned on one side of the recess 152 towards the respective transverse wall section 28-2 of main flange 30-2, and is defined by a generally wedge shaped side wall 154 which is joined at one upright end edge thereof to a vertical wall 155 which projects transversely inwardly from the respective web 43-2 to provide the upright 153 with a corner-shaped configuration. The lower free edge of vertical wall 155 projects downwardly to a height approximately the same as the height of center wall 45-2 between the respective shoulders 50-2. A vertically short wall 157 is disposed on the side of recess 152 opposite upright 153 and projects downwardly from top wall 12-2 beyond the normal height of longitudinal web 43-2 but terminates short of the height of vertical wall 155. As shown in FIG. 15, the inner upright edges of the respective adjacent vertical walls 155 define a vertical gap or slot 158 therebetween for a purpose discussed below.

The pairs of outermost longitudinal webs 43-2 on opposite sides of the respective central support plates 151 define thereon additional outer support plates 151A, each of which defines a semi-circular and downwardly opening recess 152A therein. The outer support plates 151A are similar to center support plates 151, except that support plates 151A do not define thereon uprights 153. The recesses 152 are horizontally aligned with recesses 152A in the transverse direction of top 12-2, but the recesses 152 of central support plates 151 are slightly downwardly offset relative to the recesses 152A of outer support plates 151A.

With reference to FIGS. 15 and 16, a plurality of generally wedge-shaped rail guides 160 are cantilevered downwardly from respective transverse webs 44-2. These rail guides 160 each define an upright end surface 161 which is spaced horizontally inwardly from, and generally parallel to, the inner surface 63-2 of main flange 30-2. This end surface 161 together with the uppermost edge of the respective transverse web 44-2 and the inner surface 63-2 of main flange 30-2 defines a downwardly opening channel 162. In the illustrated embodiment, four guides 160 are longitudinally spaced from one another along each longitudinal wall section 28A-2 of main flange 30-2. The respective channels 162 defined by the guides 160 located along one wall section 28A-2 are horizontally and vertically aligned with one another such that a pair of elongate channels which extend longitudinally relative to top 11-2 are defined adjacent each of the longitudinal wall sections 28A-2 of main flange 30-2.

A rail and leg mounting element 165 projects downwardly from top wall 12-2 generally adjacent each of the intersections or corners defined by the respective interconnected pairs of transverse and longitudinal wall sections 28-2 and 28A-2 of main flange 30-2. The mounting elements 165 each include a first leg 166 which projects inwardly in a generally perpendicular manner from the inner surface 63-2 of a transverse wall section 28-2 of main flange 30-2, and a second leg 167 which is joined to an inner edge of first leg 166 and projects perpendicularly therefrom in a direction away from the adjacent longitudinal wall section 28A-2. First leg 166 is spaced horizontally inwardly from and is generally parallel to the respective longitudinal wall section 28A-2 of main flange 30-2, and along with the inner surface 63-2 thereof defines a rail-receiving channel 168 which is aligned with the channels 162 defined by guides 160 disposed along the respective longitudinal wall section 28A-2. A pair of leg-socket mounting bosses 169 project downwardly from top wall 12-2 and are longitudinally spaced from one another and interconnected via a web 170. In the illustrated embodiment, the boss 169 disposed closest to the transverse wall section 28-2 of main flange 30 is adjoined to the inner edge of second leg 167. The bosses 169 each define therein a mounting hole 171.

As shown in FIGS. 14 and 16, a pair of elongate and rigid rails 175 which are mounted on top member 11-2 at the lower side 14-2 thereof along the respective longitudinal wall sections 28A-2 of main flange 30-2. The rails 175 are identical to one another and each includes a pair of upright and generally parallel side walls 176 which are joined to one another by a pair of generally parallel top and bottom walls 177. The rails 175 each thus define a hollow interior 178 which opens sidewardly at opposite ends of the respective rail 175. The rails 175 are mounted to the lower side 14-2 of top wall 12-2 as follows. The rail 175 is positioned along a respective longitudinal wall section 28A-2 of main flange 30 so that the terminal ends thereof seat within the respective channels 168 of mounting elements 165, and the intermediate section of rail 175 is positioned within the aligned channels 162 between the respective guides 160 and the opposed longitudinal wall section 28A-2. More specifically, as shown in FIG. 16, the upright side walls 176 of the rail 175 are disposed in juxtaposed and face-to-face relation with the upright surface 161 of guide 160 and the inwardly facing surface 63-2 of longitudinal wall section 28A-2 of flange 30-2, respectively, and the top wall 177 of rail 175 is disposed closely adjacent the upper edge of the transverse web 44-2 adjacent the respective guide 160. The rail 175 is then secured to the respective longitudinal wall section 28A-2 via fasteners 179, such as threaded fasteners which project sidewardly through wall section 28A-2 and upright side wall 176 of rail 175 into the hollow interior 178 thereof. In this regard, side wall 176 may be provided with pre-drilled or preformed holes longitudinally therealong.

In some situations, it may be necessary or desirable to additionally or alternatively secure rails. 175 directly to the underside of top wall 12-2. For this purpose, bosses 160A may be provided which project downwardly from top wall 12-2 and are longitudinally spaced along each longitudinal section 28A-2 of main flange 30-2. In this situation, fasteners would be inserted through vertically aligned pre-drilled holes in top and bottom walls 177 of rail 175 and into mounting holes of the respective bosses 160A.

Figure 18:
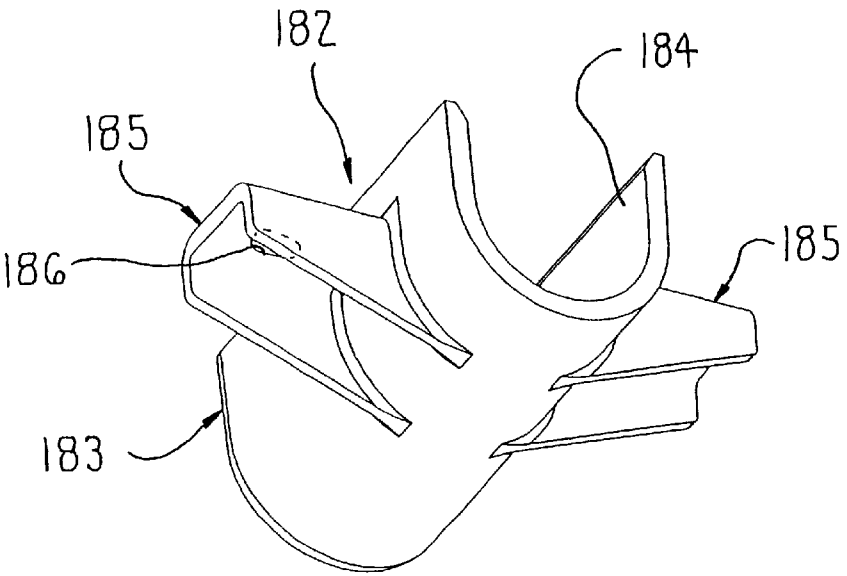
FIG. 18 is an enlarged perspective view of a leg socket utilized in the embodiment of FIG. 14.

The top leg member 96-2 of each leg assembly 20-2 is secured to top member 11-2 via a pair of mounting sleeve 182 as shown in FIGS. 14 and 18. The sleeves 182 are identical to one another and only one of which will be discussed herein. Sleeve 182 includes a generally U-shaped brace 183 which defines therein an upwardly and sidewardly opening elongate channel 184. A pair of mounting arms 185 are cantilevered from opposite sides of brace 183 and each arm 185 defines a mounting hole 186 therein (only one of which is shown in FIG. 18). In the illustrated embodiment, the mounting arms 185 are shaped as downwardly opening channel members.

As shown in FIG. 14, the top leg members 96-2 of the respective leg assemblies 20-2 are secured to the lower side 14-2 of top 11-2 as follows. Top leg member 96-2 is positioned so as to be generally parallel to and spaced slightly inwardly from a respective transverse wall section 28-2 of main flange 30-2. The top leg member 96-2 is fixed to top 11-2 by positioning a mounting sleeve 182 over each terminal end thereof so that same project within the respective channels 184, and inserting fasteners into the mounting holes 186 of arms 185 and into the respective aligned mounting holes 171 of bosses 169. The outer ends of the respective sleeves 182 are positioned closely adjacent the outwardly facing side wall 176 of the respective rail 175 once installed on top 11-2.

It will be appreciated that the configuration of mounting sleeve 182 and the fastening thereof to top 11-2 allows the respective top leg member 96-2, and hence the respective leg 95-2 to pivot relative thereto generally about the longitudinal axis of the top leg member 96-2, which axis extends horizontally transversely relative to the top 11-2. This pivoting movement of each leg assembly 20-2 is limited by a strut arrangement 108-2 which cooperates with a pivot shaft or journal 188 (similar to journal 109) mounted to lower side 14-2 of top member 11-2.

Figure 17:
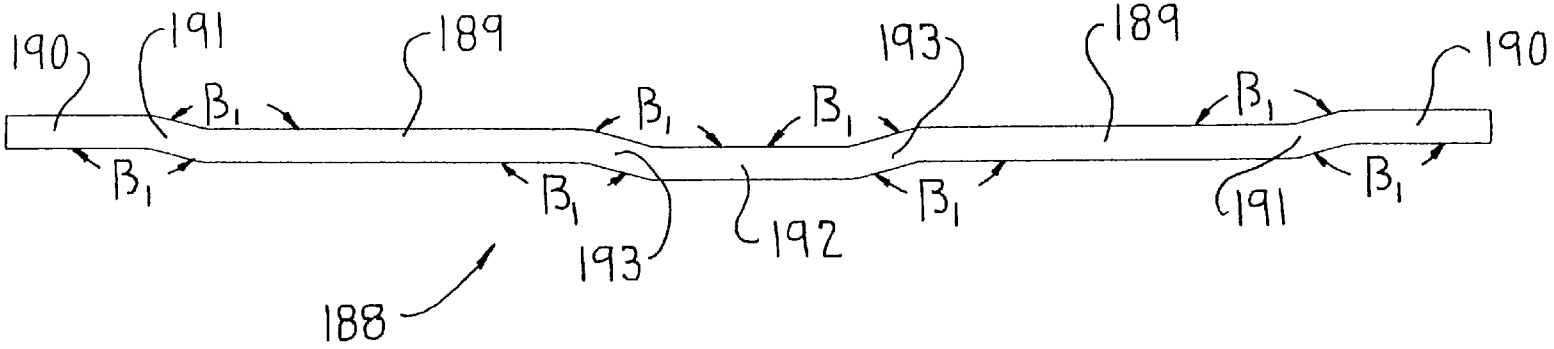
FIG. 17 is an enlarged view of a pivot shaft utilized in the embodiment of the table illustrated in FIG. 14.

The two pivot shafts 188 are identical to one another and only one of such shafts is described herein with reference to FIGS. 14 and 17. Pivot shaft 188 has a pair of straight intermediate sections 189 which are coaxially aligned with one another and terminate in respective coaxially aligned straight end parts 190. End parts 190 are joined to the respective intermediate sections 189 via angled sections 191. In the illustrated embodiment, each angled section 191 and the respective intermediate section 189 together define an angle $\beta_1$ of about 150° to about 170°, and preferably about. 165°. The inner ends of intermediate sections 189 opposite the respective end parts 190 are connected to a straight middle section 192 via further angled sections 193. Angled sections 193 and the adjacent respective end parts 190 together define angle $\beta_1$. Further, the middle section 192 is parallel to but offset from the respective intermediate sections 189.

The pivot shafts 188 are preferably secured to the lower surface 14-2 of table 150 prior to mounting of the rails 175 thereon. More specifically, the middle section 192 of shaft 188 is inserted into the recesses 152 of central support plates 151, and the respective intermediate sections 189 are inserted into the recesses 152A of the outer pairs of support plates 151A. The end parts 190 of the pivot shaft 188 are then positioned closely adjacent the lower side of top wall 12-2 and extend generally parallel to and alongside a respective transverse web 44-2, as shown in FIG. 16. The opposite shaft 188 is positioned within the recesses 152 and 152A in the same manner on the opposite side of center wall 45-2. Once both pivot shafts 188 are positioned on lower side 14-2, the rails 175 are then mounted on lower side 14-2 along the respective longitudinal wall sections 28A-2 of main flange 30-2 as discussed above, so that the end parts 190 of each shaft 188 are effectively confined between the lower surface of top wall 12-2 and the top wall 177 of the respective rail 175. The pivot shafts 188 are thus secured vertically relative to top part 11-2 via the respective rails 175, and horizontally relative to top part 11-2 via the support plates 152 and 152A and the inwardly facing surfaces 63-2 of the main flange 30-2.

The strut arrangement 108-2 is similar if not identical to the strut arrangement 108, and the terminal end of the center brace 117-2 is pivotally connected to middle section 192 of the respective pivot shaft 188. In the folded position of leg assemblies 20-2, the cross members 99-2 are positioned closely adjacent the respective intermediate sections 189, the central portion of base leg 97-2 is positioned against the shoulder 50-2 of center wall 45-5, and the terminal ends of the base leg 97-2 are positioned along the inner side walls 176 of the respective rails 175. Further, the uprights 153 of the respective pairs of support plates 151 serve as stops to prevent advancement of the corresponding locking tube 119-2 towards the respective pivot shaft 188 which could interfere with the movement of brace 117-2 during manipulation of the leg assembly 20-2.

The table 150 depicted in FIGS. 14 and 15 may be provided in varying lengths, and in the illustrated embodiment has a length of approximately six feet as measured between end edges 17-2 and 18-2.

Figure 19:
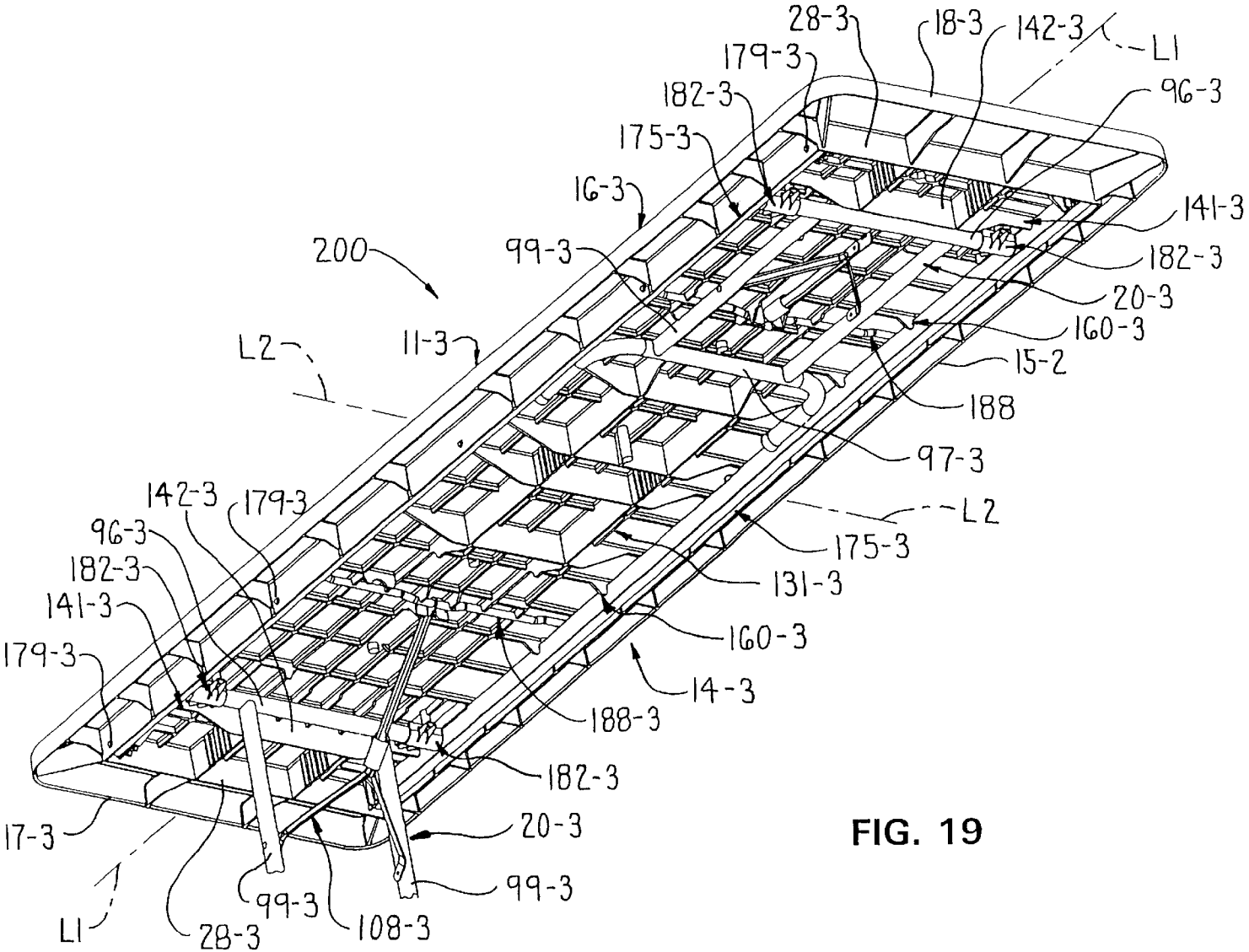
FIG. 19 is a fragmentary perspective view of the underside of a table according to an additional preferred embodiment of the invention, with one leg assembly shown in the upright position.
Figure 20:
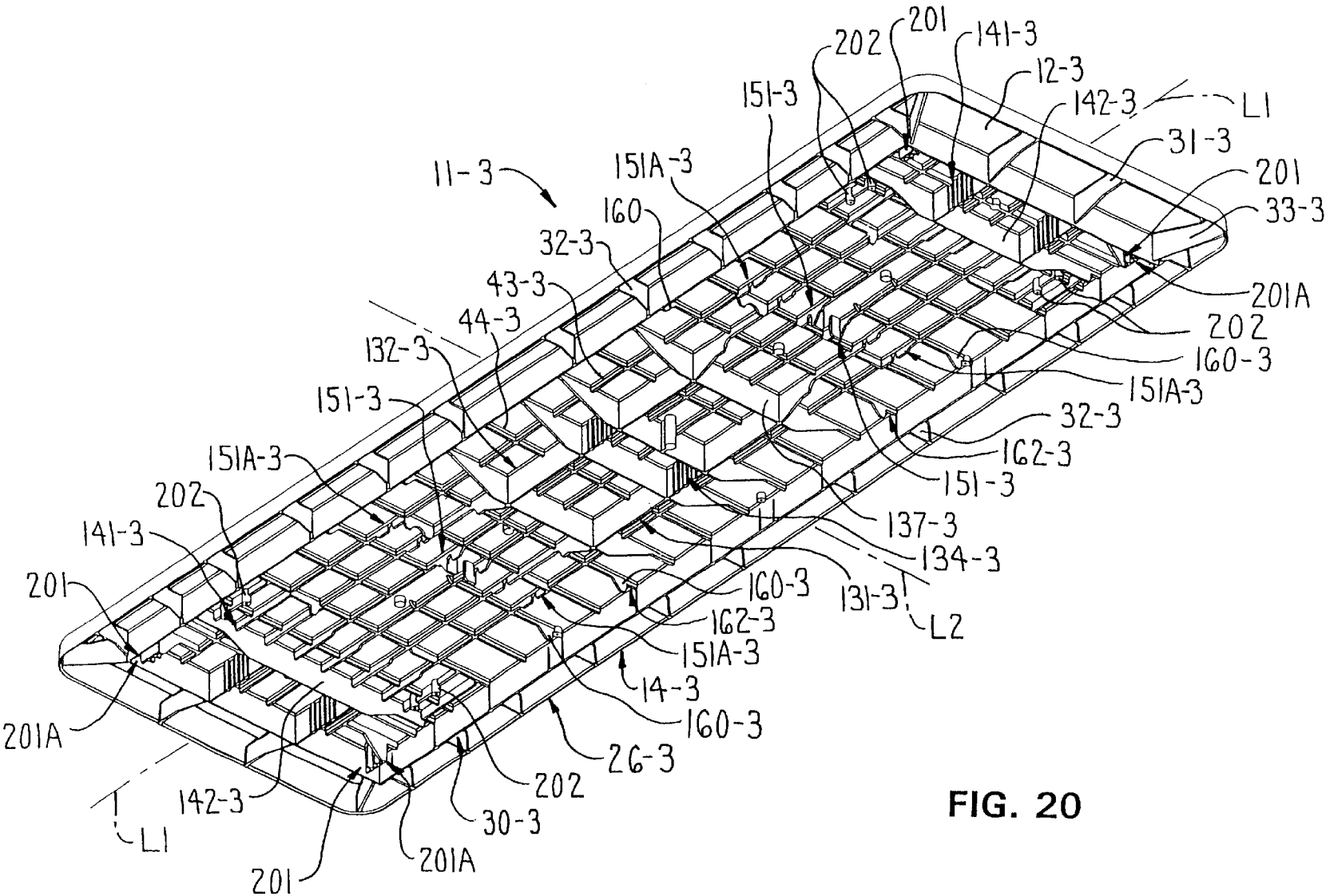
FIG. 20 is a perspective view similar to FIG. 19, but showing the one-piece top without the leg assemblies and securing structures associated therewith.

FIGS. 19 and 20 illustrate a further preferred variant of the table according to the invention, and specifically a table 200 which includes a center wall and handle arrangement and additional wall and handle arrangements adjacent each of the ends of the table 200 which are similar in configuration to table 130 illustrated in FIGS. 12 and 13. These wall and handle arrangements are adapted for a table having lengths of approximately eight feet or more. The table 200 is also similar in configuration to table 150 discussed above, and accordingly the same reference numbers plus a "-3" are utilized to depict components which are similar or identical to components of tables 130 and 150.

With reference to FIG. 19, table 200 includes a centrally located center wall and handle arrangement 131-3, and a wall and handle arrangement 141-3 located adjacent each of the end edges 17-3 and 18-3 thereof which are similar in configuration and location to that of table 130. Further, the lower side 14-3 of table 200 defines thereon pairs of central support plates 151-3, additional outer support plates 151A-3, and rail guides 160-3 similar to table 150 discussed above. Table 200 also includes mounting elements 201 which are similar to mounting elements 165 of table 150, but are not adjoined to leg mounting bosses. Instead, the pairs of leg mounting bosses 202 are disposed slightly inwardly of, and are arranged generally perpendicular relative to, the respective end walls 142-3.

In the embodiment shown in FIGS. 19 and 20, rails 175-3 are provided on top part 11-3 and have a length which generally corresponds to the distance defined longitudinally between the respective transverse sections 28-3 of main flange 30-3. The pivot shafts 188-3 are positioned within the recesses of support plates 151-3 and 151A-3, and rails 175-3 are positioned within the aligned channels 162-3 of guides 160-3 and channels 201A of mounting elements 201 below pivot shafts 188-3 and are secured to top part 11-3 via fasteners as discussed above with regard to table 150. Further, the leg assemblies 20-3 are secured to top part 11-3 so that top leg member 96-3 extends along a respective end wall 142-3, and the terminal ends of top leg member 96-1 are secured to top wall 12-3 via mounting sleeves 182-3 and mounting bosses 202 located slightly inwardly of and transversely relative to a respective end wall 142-3.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A portable table, comprising:

a horizontally enlarged, one-piece, monolithic plastic table top member having a horizontally enlarged top wall defining thereon a pair of generally parallel and longitudinally extending side edges joined together by a pair of generally parallel end edges extending transversely between said side edges, said top wall having upper and lower sides which face away from one another;

said monolithic plastic top member having a reinforcing rib structure integral with said top wall and projecting generally downwardly from said lower side thereof, said reinforcing rib structure including a main flange which extends generally downwardly from said lower side and has a generally rectangular configuration when viewed from below so as to define therein a generally rectangularly-shaped central cavity which opens downwardly, said main flange including a pair of generally parallel and longitudinally extending first wall portions which extend generally parallel with and are spaced inwardly from the respective side edges and which are joined by a pair of generally parallel and transversely extending second wall portions which extend generally parallel with and are spaced inwardly from the respective end edges;

said rib structure also including an edge flange which is joined to and extends downwardly from said top wall and which extends lengthwise along each of said side and end edges so that said edge flange has a generally rectangular configuration which is spaced outwardly from and generally encircles said main flange;

said rib structure also including a plurality of cross ribs which are fixed to and project downwardly from the lower side of said top wall and which extend transversely between and are monolithically joined to said main flange and said edge flange, said cross ribs being spaced apart from one another along the periphery of said top wall; and a leg structure engaged with said top member at the underside thereof and positioned to project downwardly for supportive engagement with a floor.

2. The table according to claim 1, wherein each of said main and edge flanges terminates at a lower free edge, and wherein said main flange has a vertical extent which is significantly greater than the vertical extent of said edge flange so that the lower free edge of said main flange is disposed downwardly a substantial distance below the lower free edge of said edge flange.

3. The table according to claim 1, wherein said rib structure includes a center wall which is integrally and monolithically joined to said top wall and projects downwardly from the lower side thereof, said center wall being elongated generally along or adjacent to a longitudinally extending centerline of said top member so as to be disposed between and extend generally parallel with the longitudinally extending first wall portions of said main flange, said center wall projecting vertically downwardly from said top wall through a distance which is similar in magnitude to the vertical downward extension of said edge flange, and said center wall having an enlargement defined thereon substantially midway between opposite ends of the table top member so as to define a handle portion for manual gripping of the table top member.

4. The table according to claim 1, wherein the rib structure includes a plurality of small reinforcing ribs which are secured to and project downwardly from the lower side of said top wall and which are provided solely within the cavity defined by said main flange, said small reinforcing ribs including pluralities of first and second ribs which extend in generally transverse relationship with one another to define a lattice-like pattern and which extend transversely between and integrally join to the longitudinally and transversely extending wall portions of said main flange, said small reinforcing ribs projecting vertically downwardly from said top wall through a vertical extent which is only a small fraction of the downward vertical extension of said main flange.

5. The table according to claim 1, wherein said leg structure includes a pair of generally identical folding leg assemblies which are pivotally mounted on said top member and swingably movable between a storage position wherein the legs project generally parallel with the top wall and are nested within the cavity defined by said main flange and a generally upright position wherein the legs project downwardly from the top member for supportive engagement with a floor;

each leg assembly including a top portion which is positioned within said cavity generally adjacent one of said transversely extending second wall portions and is connected so as to define a generally horizontally and transversely extending hinge axis for the respective leg assembly, the leg assembly also including an elongate leg part which is joined to said top portion and projects transversely therefrom to a free end, said transversely projecting leg part being positioned within said cavity when the leg assembly is in the stored position.

6. The table according to claim 5 including a pair of elongate and rigid rails positioned within said cavity respectively adjacent and extending longitudinally along said longitudinally extending first wall portions and being fixed relative thereto, a pair of support shafts disposed in generally transversely extending and parallel relationship within the cavity and extending between and having opposite ends thereof mounted adjacent the respective said rails, and a brace assembly associated with each said leg assembly, one end of said brace assembly being pivotally connected to a respective one of said shafts and the other end of said brace assembly being pivotally connected to the respective said leg part.

7. The table according to claim 5, wherein said top member includes two pairs of mounting bosses formed integrally and monolithically with said top wall and projecting downwardly therefrom within said cavity adjacent each said second wall portion, a pair of mounting elements positioned within said cavity adjacent each said second wall portion, each said mounting element being fixed to one said pair of mounting bosses and said mounting elements defining spaced but longitudinally aligned openings for pivotally accommodating therein the top portion of said leg.

8. The table according to claim 7 wherein said first wall portions each include an upright inner surface which faces away from said edge flange, said table further including a plurality of guide elements integral with said top wall and projecting downwardly from said lower side within said cavity, each said guide element having a generally vertical surface which is horizontally spaced from said inner surface of the respective first wall portion to define a channel therebetween, said guide elements being spaced longitudinally from one another along each said first wall portion of said main flange, each said rail having a generally upright side wall superimposed on and fixed to said inner surface of the respective said first wall portion and an opposite upright side wall superimposed on the respective surfaces of said guide elements.

9. The table according to claim 8 further including a pair of journals disposed in generally parallel relation within said cavity, each said journal extending transversely between the respective said rails and having a pair of terminal ends each of which is sandwiched between a vertical space defined between the lower side of said top wall and an upper wall of the respective said rail which interconnects said side walls thereof to secure said journal to said top member.

10. The table according to claim 1 wherein said rib structure includes a pair of center walls which are integrally and monolithically joined to said top wall and project downwardly from said lower side thereof, said center walls being elongated and straddling a longitudinally extending centerline of said top member and being generally parallel with said longitudinally extending first portions of said main flange, each said center wall defining thereon a handle portion approximately midway between opposite ends of said top member.

11. The table according to claim 10 wherein said rib structure includes a plurality of walls integral with said top wall which transversely interconnect said center walls, said walls extending transversely between and integrally joining said longitudinally extending first wall portions.

12. The table according to claim 1 wherein said rib structure includes a pair of walls integral with said top wall, each said wall being spaced inwardly from and being generally parallel to a respective said transversely extending second wall portion, and a pair of transversely-spaced wall sections which extend transversely between and interconnect each said wall and the respective adjacent said second wall portion, each said wall section defining thereon a handle portion for manipulating opposite ends of said table during transport;

said leg structure includes a pair of generally identical folding leg assemblies which are pivotally mounted on said top member and swingably movable between a storage position wherein the legs project generally parallel with the top wall and are nested within said cavity and a generally upright position wherein said legs project downwardly from said top member for supportive engagement with a floor, each said leg assembly including a top portion which is positioned within said cavity in close proximity to one of said walls and is connected so as to define a generally horizontally and transversely extending hinge axis for the respective leg assembly.

13. A table comprising:

a horizontally enlarged top having a pair of longitudinal edges joined by a pair of end edges extending transversely therebetween, said top having upper and lower sides which face away from one another;

a flange structure extending generally downwardly from said lower side of said top and having a pair of transversely spaced longitudinal sections which are generally parallel with said longitudinal edges;

a pair of elongate rails positioned adjacent the respective longitudinal sections of said flange structure and secured to said lower side;

a pair of elongate shafts extending transversely between said rails, each said shaft having a pair of terminal ends supported on said top wall adjacent the respective rails;

a pair of leg assemblies connected to said top at said lower side thereof, said leg assemblies being pivotable relative to said top into a generally upright position to support said top in spaced relationship above a support surface such as a floor, said leg assemblies each including a brace arrangement associated therewith for rigidly supporting said leg assembly in said upright position, each said brace arrangement being pivotally connected to a respective said shaft;

each said rail having a box-like structure defined by a pair of generally parallel side legs and top and bottom legs which extend between and interconnect said side legs, one of said side legs being fixed to an inwardly facing surface of the respective longitudinal section to secure said rail to said lower side of said top; and a plurality of generally upright guides are longitudinally spaced from one another along each said longitudinal section, each said rail being disposed between said guides and the respective said longitudinal section such that the other said side leg thereof is positioned along said guides.

14. The table according to claim 13 wherein said terminal ends of each said shaft are secured between said top leg of said rail and said lower side of said top.

15. A table comprising:

a horizontally enlarged top having a pair of longitudinal edges joined by a pair of end edges extending transversely therebetween, said top having upper and lower sides which face away from one another;

a flange structure extending generally downwardly from said lower side of said top and having a pair of transversely spaced longitudinal sections which are generally parallel with said longitudinal edges;

a pair of elongate rails positioned adjacent the respective longitudinal sections of said flange structure and secured to said lower side;

a pair of elongate shafts extending transversely between said rails, each said shaft having a pair of terminal ends supported on said top wall adjacent the respective rails;

a pair of leg assemblies connected to said top at said lower side thereof, said leg assemblies being pivotable relative to said top into a generally upright position to support said top in spaced relationship above a support surface such as a floor, said leg assemblies each including a brace arrangement associated therewith for rigidly supporting said leg assembly in said upright position, each said brace arrangement being pivotally connected to a respective said shaft; and a plurality of mounting plates which extend downwardly from said top each defining therein a generally semicircular channel which opens downwardly, said mounting plates being arranged in rows which extend transversely between the opposed pair of said rails, each said shaft being engaged within said channels of the respective said row of mounting plates.

16. A table comprising:

a horizontally enlarged, one-piece, monolithic plastic top having a pair of longitudinal edges joined by a pair of end edges extending transversely therebetween, said top having upper and lower sides which face away from one another;

a pair of elongate rails secured to said lower side and extending longitudinally therealong adjacent the respective said longitudinal edges;

a pair of leg assemblies connected to said top at said lower side thereof, said leg assemblies being pivotable relative to said top between a generally upright position and a folded position adjacent said lower side, said leg assemblies each including an elongate mounting leg extending transversely between said rails and having a pair of terminal ends respectively pivotably mounted adjacent each said rail, and a base leg connected to said mounting leg for engagement with a support surface such as a floor in said upright position; and a plastic rib cantilevered outwardly from said lower side and integral with said top, said rib extending longitudinally and being disposed between said end edges and spaced from each said longitudinal edge, said rib defining thereon a handle member disposed generally centrally on said lower side for manipulating said table during transport thereof.

17. A table according to claim 16, wherein said rib defines thereon a pair of handle members disposed adjacent opposite sides thereof.

* * * * *